US005583552A

United States Patent [19]

Mutoh

[11] Patent Number: 5,583,552

[45] Date of Patent: Dec. 10, 1996

[54] OPTIMUM PHASE DETERMINATION BASED ON THE DETECTED JET CURRENT

[75] Inventor: Masayuki Mutoh, Machida, Japan

[73] Assignee: Silver Seiko Ltd., Tokyo, Japan

[21] Appl. No.: 339,153

[22] Filed: Nov. 10, 1994

Related U.S. Application Data

[62] Division of Ser. No. 798,198, Nov. 26, 1991, Pat. No. 5,450,111.

[30] Foreign Application Priority Data

Nov. 29, 1990 [JP] Japan ..... 2-332335

[51] Int. Cl.[6] ..... B41J 2/115

[52] U.S. Cl. ..... 347/80

[58] Field of Search ..... 347/14, 19, 78, 347/80, 81, 90

[56] References Cited

U.S. PATENT DOCUMENTS

| | | | |
|---|---|---|---|
| 3,560,641 | 12/1971 | Taylor | 347/42 X |
| 3,969,733 | 7/1976 | DeMoss et al. | 347/80 |
| 3,999,188 | 12/1976 | Yamada | 347/80 |
| 4,418,352 | 11/1983 | Horike et al. | 347/80 |
| 4,839,665 | 6/1989 | Hertz | 347/80 |

FOREIGN PATENT DOCUMENTS

| | | | |
|---|---|---|---|
| 2425679A1 | 5/1974 | Germany . | |
| 2350870A1 | 4/1975 | Germany . | |
| 3110260C2 | 2/1982 | Germany . | |
| 62-68761 | 3/1987 | Japan . | |
| 62-33647 | 7/1987 | Japan . | |
| 62-225363 | 10/1987 | Japan . | |
| 63-264361 | 10/1989 | Japan . | |
| 2-258350 | 10/1990 | Japan | 347/80 |
| 1210203 | 10/1970 | United Kingdom . | |
| 1399066 | 6/1975 | United Kingdom . | |
| 1405197 | 9/1975 | United Kingdom . | |
| 1413257 | 11/1975 | United Kingdom . | |
| 1438069 | 6/1976 | United Kingdom . | |
| 1488035 | 10/1977 | United Kingdom . | |
| 1491778 | 11/1977 | United Kingdom . | |
| 1535348 | 12/1978 | United Kingdom . | |

*Primary Examiner*—John E. Barlow, Jr.
*Attorney, Agent, or Firm*—Wallace G. Walter

[57] ABSTRACT

An ink jet recording apparatus wherein ink drops can be controlled individually to assure high quality printing and adjustment in registration of ink nozzles in a drum circumferential direction can be performed at a sufficiently high resolution. The ink jet recording apparatus has a plurality of nozzles arranged such that drops of ink may impinge in an overlapping relationship at a location on a record medium supported on a rotary drum, and adjustment in registration of the nozzles in a drum circumferential direction is performed by a registration adjusting system by which such adjustment is performed using a registration adjusting clock signal having a frequency higher than a picture element recording signal. An optimum phase between disintegration of an ink jet and a recording pulse signal is determined in accordance with current values detected by a current detector connected to an electrically isolated conductive drop catcher.

10 Claims, 11 Drawing Sheets

OPTIMUM PHASE DETERMINATION BASED ON THE DETECTED JET CURRENT

This is a division of application Ser. No. 07/798,198, filed Nov. 26, 1991 U.S. Pat. No. 5,450,111.

BACKGROUND OF THE INVENTION

1. Field of the Invention

This invention relates to an ink jet recording apparatus, and more particularly to an ink jet recording apparatus of the continuous jet type wherein ink is jetted continuously from a nozzle of an ink jet recording head.

2. Description of the Prior Art

Various ink jet recording apparatus are conventionally known and particularly used. One of such conventional ink jet recording apparatus is of the continuous jet type wherein ink is jetted continuously from an ink jet recording head. An exemplary one of such conventional continuous jet type ink jet recording head is shown in FIG. 19. As shown in FIG. 19, the continuous jet type ink jet recording head shown includes an ink bottle 91 in which ink is accommodated, an ink pump 92 for applying a pressure to ink from the ink bottle 91 and sending out the thus pressurized ink, an ink tube 93 for supplying ink from the ink pump 92 therethrough, a nozzle 94 having a circular orifice of a very small diameter, an ink electrode 95 for holding the potential of ink in the nozzle 94 at a ground level, a vibrating element 96 in the form of a piezoelectric vibrating element mounted on the nozzle 94, a vibrating element driving vibrator 97 for applying an exciting signal to the vibrating element 96, a controlling electrode 98 having a circular opening or a slit-like opening coaxial with the nozzle 94 for receiving a controlling signal to control charging of a jet of ink, a grounding electrode 99 disposed in front of the controlling electrode 98 and grounded itself, a knife edge 100 mounted on the grounding electrode 99, a deflecting high voltage dc power source (hereinafter referred to as deflecting power source) 101, and a deflecting electrode 102 connected to the deflecting power source 101 for cooperating with the grounding electrode 99 to produce therebetween an intense electric field perpendicular to an ink jet flying axis to deflect a charged ink drop to the grounding electrode 99 side. The thus deflected charged ink drop is propelled to a record medium 104 wrapped around a rotary drum 103.

In such conventional continuous jet type ink jet recording apparatus, ink pressurized by the ink pump 92 is introduced by way of the ink tube 93 into the nozzle 94, at which a jet of the ink is formed from the orifice thereof. The ink jet is disintegrated into a train of ink drops with a spontaneous disintegrating frequency which depends upon a diameter and a flow rate of the ink jet and physical properties of the ink. In this instance, if the exciting frequency of the vibrating element 96 mounted on the nozzle 94 is set to a value at or around the spontaneous disintegrating frequency, then disintegration will be synchronized with excitation of the vibrating element 96, and consequently, ink drops of a very uniform size are produced in accordance with the exciting frequency.

Ink drops disintegrated in this manner are charged, upon separation from the ink jet, by electrostatic induction by way of an integrating circuit composed of an electric resistance Rj of the ink jet and an electrostatic capacitance between the ink jet and the controlling electrode 98. Thus, if the controlling signal is a rectangular wave having an amplitude $\phi c$, then a potential of an ink drop immediately before disintegration is given by $$\phi j - \phi c(1-\exp(-t/CjRj))$$

If the uniform ink drops separated from the ink jet are charge modulated in accordance with a controlling signal (recording pulse signal) synchronized in phase with an exciting signal, then such charged ink drops will be deflected to the grounding electrode 99 side by an action of the deflecting electric field and cut by the knife edge 100 while only non-charged ink drops are allowed to advance straightforwardly and pass by the knife edge 100 so that they form dots of ink on the record medium 104 wrapped around the rotary drum 103.

Now, if the exciting frequency (disintegrating frequency) is set to $f_d$ and an ink jet is pulse width modulated by a frequency of $f_d/n$, then a picture image of n gradations with a controlled dot diameter can be recorded at the frequency of $f_d/n$.

In the conventional continuous jet type ink jet recording apparatus described above, the exciting signal to the vibrating element 96 and the controlling signal (recording pulse) to the controlling electrode 98 must be synchronized with each other maintaining a certain optical phase relationship. In particular, while an ink dot is produced in synchronism with an exciting signal, a timing at which an ink jet disintegrates into an ink drop is varied delicately during one period of an exciting signal by a variation of parameters such as a temperature, an ink pressure and physical properties of ink. If such timing of disintegration and the controlling signal (recording pulse) are displaced in phase from each other, then the electric resistance Rj of an ink jet presents a very high value immediately before disintegration, and consequently, an edge of the controlling signal (recording pulse) comes within a region (hereinafter referred to as forbidden region) where the resistance is very high. Accordingly, charging of an ink drop takes place but incompletely, and an incompletely charged ink drop is produced. If an incompletely charged ink drop is produced, then it is impossible to individually control ink drops accurately. As a result, a spot-like noise is produced mainly at a highlight portion of a recorded picture image.

A technique of merely synchronizing an exciting signal and a controlling signal (recording pulse) with each other is disclosed, for example, in Japanese Patent Laid-Open Application No. 62-225363, Japanese Patent Laid-Open Application No. 63-264361 and so forth.

Meanwhile, a method of determining an optimum phase between an exciting signal and a controlling signal (recording pulse) is disclosed, for example, in U.S. Pat. No. 4,839,665, wherein an ink jet is charged either in accordance with a probe pulse having a smaller width than a period ($1/f_d$) of an exciting signal or another probe pulse having a pair of pulses having an equal amplitude and an equal pulse width within one period of such exciting signal but having the opposite polarities to each other while changing the phase of the probe pulse, and a current which flows together with an ink jet (such current will be hereinafter referred to as jet current) is successively measured to find out an optimum phase from measured values of the jet current. However, such jet current is a very low current (10 to 100 nA) and a current source is exposed to various noises. With an actual machine, it is difficult to shield such current source from external noises. Particularly, noises (hums) from a commercial power supply of, for example, ac 100 V matter.

A method of measuring a jet current is also disclosed in U.S. Pat. No. 4,835,665 mentioned above wherein a current detecting resistor is interposed between an ink electrode and the ground to convert a jet current into a voltage. Another method wherein an ink electrode is connected to a virtual grounding point of an operational amplifier constituting a current to voltage converter is disclosed in No. PCT/US88/03311. The two methods are advantageous in that, where a continuous jet type ink jet recording apparatus includes a plurality of nozzles like a color ink jet printer, a jet current can be detected independently for each of the nozzles. However, in order to introduce all of jet currents to a current detector, entire ink supplying systems from ink bottles to nozzles including ink pumps must be kept in an electrically isolated condition. Further, each of such ink supplying systems includes a very long ink tube and so forth and accordingly makes a very harmful noise source. Accordingly, it is difficult to measure a jet current at a high S/N ratio.

A further method of detecting a jet current flowing between a grounding electrode and a deflecting electrode is disclosed in U.S. Pat. No. 4,839,665 mentioned hereinabove. The method is superior to the method which makes use of an ink electrode in that a jet current can be measured at a high S/N ratio with low noises. However, it has the following problems:

(1) while measurement is easier on the grounding electrode side to which no high voltage is applied, in such instance, the grounding electrode, which is soiled with waste liquid, must be kept in an isolated condition; and (2) even in continuous jet type ink jet recording apparatus such as a color ink jet printer which includes a plurality of nozzles, only one deflecting electrode and only one grounding electrode are provided, and in this instance, since waste liquid from the nozzles come to the single grounding electrode, a jet current cannot be measured independently for each of the nozzles.

Also a method is disclosed in U.S. Pat. No. 4,839,665 mentioned hereinabove wherein an electrically isolated conductive ink catcher is provided in front of a grounding electrode and a deflecting electrode, and a current detecting resistor is interposed between the conductive ink catcher and the ground to detect a jet current. While the method is better then the two methods described above, since a signal source has a high impedance of $10^9$ to $10^{10}$ Ω. also the current detecting resistor must be high in resistance, which makes it easy to admit noises. Consequently, measurement of a jet current at a high S/N ratio cannot be achieved. Thus, an alternative measuring method using an ac technique, that is, a method wherein a probe pulse is amplitude modulated and a jet current is detected by means of a narrow-band amplifier, is disclosed in U.S. Pat. No. 4,839,665 mentioned above. This method, however, still has a problem that a circuit system is complicated and expensive and the stability is low because an amplitude modulated probe pulse is used.

As described above, an ink jet printer such as a color ink jet printer normally includes a plurality of nozzles. In particular, where the conventional continuous jet type ink jet recording apparatus described hereinabove with reference to FIG. 19 is constructed as such ink jet printer, it includes a plurality of such continuous jet type jet ink recording heads as described above. In this instance, the continuous jet type ink jet recording heads are provided independently of each other while the grounding electrode 99, knife edge 100, deflecting power source 101 and deflecting electrode 102 are provided commonly to the ink jet recording heads. In such an ink jet printer, the nozzles 94 of the ink jet recording heads are disposed in line either in an axial direction (hereinafter referred to as the drum axial direction) or in a circumferential direction (hereinafter referred to as the drum circumferential direction) of the rotary drum 103.

By the way, since the nozzles 94 are different in directions of axes of ink jets therefrom (nozzle axes) and in flying speeds of such ink jets, they must be adjustable in registration. However, where flying speeds of ink jets are different, even if a controlling signal is received simultaneously by the controlling electrodes 98, times required for ink jets to reach a surface of the rotary drum 104 are different from each other. Consequently, the ink jets will be flown to displaced positions.

Adjustment in alignment of such nozzles 94 where they are arranged in line in an axial direction of the rotary drum 103 includes, as adjustment in a drum axial direction, mechanical leftward and rightward adjustment (in the drum axial direction) of the nozzles 94 and time lag adjustment the recording picture element data for the nozzles 94 (by a distance between the nozzles 94), and includes, as adjustment in a drum circumferential direction, time lag adjustment of recording picture element data for the nozzles 94.

Adjustment in registration in a drum circumferential direction is conventionally achieved by either of the following two registration adjusting mechanisms:

(1) According to such registration adjustment mechanism as disclosed, for example, in Kent Bladh. Report 1, Dept. Electr. Meas., Lund Inst. Tech., 1982, pp. 112–114 or in Japanese Patent Laid-Open Application No. 62-225363, delay circuits having delay times adjustable independently of each other are provided for nozzles for four different colors (C (cyan), M (magenta), Y (yellow) and BK (black)). Each of the delay circuits is composed of a serial-in/serial-out type shift register and an oscillator having a variable vibration frequency and having an output to be supplied as a shift clock signal to the shift register. A time required until picture image data are outputted from the shift register after having been inputted to the shift register, that is, a delay time, can be adjusted by varying an output frequency of the oscillator.

(2) According to the other registration adjusting mechanism disclosed in Japanese Patent Laid-Open Application No. 62-33647, Japanese Patent Laid-Open Application No. 62-68761 and so forth, buffer memories (line buffers) are provided into which picture image data can be written at different addresses variable independently for four colors (C, M, Y, (and BK). Four color data are written into the buffer memories at different addresses which are displaced from each other by distances corresponding to distances between them, and reading out (printing) of data from the buffer memories is performed simultaneously for the four colors to compensate for the displacements of the nozzles.

With the first registration adjusting mechanism described above, if it is intended to raise the resolution for registration adjustment to assure a wide range of adjustment, then the oscillating frequency of the oscillator must be raised and the number of bits must be increased. Accordingly, a shift register which is higher in number of bits and can operate at a high speed (for example, a several hundreds to several kilobits shift register which operates by several megahertz) is required. However, such shift register is expense and is not readily available. Accordingly, a plurality of shift registers which do not have a sufficiently large number of bits must be connected in series in use.

Further, since the resolution in time is a reciprocal number to an oscillator frequency of the oscillator, if such frequency varies, then the resolution in registration adjusting is varied. Accordingly, in case registration adjustment is performed with a higher oscillation frequency so that a resolution for registration adjustment necessary at a minimum frequency may be assured, the resolution in registration adjustment may be unnecessarily high.

On the other hand, with the second registration adjusting mechanism described above, four color (C, M, Y and BK) picture data are written into the buffer memories at different addresses, and they are read out, upon printing, in synchronism with a picture element recording clock. Accordingly, a resolution in registration adjustment is a reciprocal number to a frequency of a picture element recording clock signal and is very low on a recording face because it is provided by recording dots on the recording face. Accordingly, the second registration adjusting mechanism is very low in resolution in registration adjustment and accordingly is not suitable for a high resolution printer.

SUMMARY OF THE INVENTION

It is an object of the present invention to provide an ink jet recording apparatus wherein ink drops can be controlled individually to assure high quality printing.

It is another object of the present invention to provide an ink jet recording apparatus wherein adjustment in registration of ink nozzles in a drum circumferential direction can be performed at a sufficiently high resolution in registration adjustment comparing with a pitch of recorded picture elements.

It is a further object of the present invention to provide an ink jet recording apparatus of the continuous jet type wherein an optimum phase between disintegration of a jet of ink and a recording pulse signal is automatically adjusted to assure high quality printing.

In order to attain the objects, according to an aspect of the present invention, there is provided an ink jet recording apparatus which comprises a plurality of nozzles for jetting therefrom ink jets, exciting means provided for each of the nozzles for causing an ink jet from the nozzle to disintegrate into drops of ink in response to an exciting clock signal, charging means provided for each of the nozzles for selectively charging such drops of ink from the nozzle in accordance with a controlling signal, the nozzles being arranged such that drops of ink formed from ink jets therefrom may impinge in an overlapping relationship at a location on a record medium supported on a rotary drum when all of the charging means for the nozzles are controlled by a same controlling signal, and a registration adjusting system including dot clock generating means for producing a first picture element recording clock signal from a rotary drum position signal representative of a rotational position of the rotary drum, the registration adjusting system further including registration adjusting means provided for each of the nozzles, each of the registration adjusting means including frequency multiplying means for multiplying a frequency of the first picture element recording clock signal to produce a first registration adjusting clock signal, start position delaying means for producing, from the first registration adjusting clock signal, a second registration adjusting clock signal which is delayed by a time corresponding to external variable instruction data from an original position pulse signal representative of an original position of the rotary drum, synchronizing means for producing, from the first picture element recording clock signal, a second picture element recording clock signal synchronized with the second registration adjusting clock signal and the exciting clock signal, a line buffer for storing picture image data therein and for being controlled in accordance with the second picture element recording clock signal to recall the stored data therefrom, controlling signal generating means for generating, from the second picture element recording clock signal, a loading signal delayed by a predetermined time, pulse width modulating means for receiving picture element data read out from the line buffer in response to the loading signal to output a pulse width modulating signal having a pulse width corresponding to the thus received picture image data, and high voltage switching means for voltage controlling the pulse width modulating signal to produce a controlling signal for the corresponding exciting means.

In the ink jet recording apparatus, the dot clock generating means produces a first picture element recording clock signal from a rotary drum position signal representative of a rotational position of the rotary drum, and the frequency multiplying means of each of the registration adjusting means multiplies a frequency of the first picture element recording clock signal from the dot clock generating means to produce a first registration adjusting clock signal. The start position delaying means produces, from the first registration adjusting clock signal from the frequency multiplying means, a second registration adjusting clock signal which is delayed by a time corresponding to external variable instruction data from an original position pulse signal representative of an original position of the rotary drum. The synchronizing means produces, from the first picture element recording clock signal from the dot clock generating means, a second picture element recording clock signal synchronized with the second registration adjusting clock signal and the exciting clock signal. The line buffer stores picture image data therein and is controlled in accordance with the second picture element recording clock signal from the synchronizing means to recall the stored data therefrom, and the controlling signal generating means generates, from the second picture element recording clock signal from the synchronizing means, a loading signal delayed by a predetermined time. The pulse width modulating means receives picture element data read out from the line buffer in response to the loading signal from the controlling signal generating means and outputs a pulse width modulating signal having a pulse width corresponding to the thus received picture image data, and the high voltage switching means voltage controls the pulse width modulating signal from the pulse width modulating means to produce a controlling signal for the corresponding exciting means.

With the ink jet recording apparatus, adjustment in registration of the nozzles in a circumferential direction is performed using the first registration adjusting clock signal having a higher frequency than the first picture element recording clock signal. Accordingly, registration adjustment can be performed with a very high resolution. Further, since the controlling signal which is adjusted in accordance with the first registration adjusting clock signal so that recording head positions of the nozzles may overlap with each other are further synchronized with the exciting clock signal for the driving of the exciting means which controls disintegration of an ink jet, ink drops can be controlled individually, and consequently, high resolution recording can be achieved. Further, if the first registration adjusting clock signal is produced from the first picture element recording clock signal, then even if the first picture element recording clock signal varies, the resolution in registration adjustment remains constant for each dot pitch, that is, the resolution in registration adjustment=dot pitch/M (M is a fixed positive integral number). Furthermore, the resolution in registration adjustment can be designated variably in accordance with an external signal from an MPU, a dip switch or the like.

According to another aspect of the present invention, there is provided an ink jet recording apparatus which comprises a plurality of nozzles for jetting therefrom ink jets, exciting means provided for each of the nozzles for causing an ink jet from the nozzle to disintegrate into drops of ink in response to an exciting clock signal, charging means provided for each of the nozzles for-selectively charging such drops of ink from the nozzle in accordance with a controlling signal, the nozzles being arranged such that drops of ink formed from ink jets therefrom may impinge in an overlapping relationship at a location on a record medium supported on a rotary drum when all of the charging means for the nozzles are controlled by a same controlling signal, and a registration adjusting system including encoder clock generating means for producing, from a rotary drum position signal representative of a rotational position of the rotary drum, an encoder clock signal including a predetermined number of clocks which divide a circumference of the rotary drum uniformly, dot clock generating means for producing a first picture element recording clock signal in accordance with an external picture element density instruction from the encoder clock signal, and registration adjusting means provided for each of the nozzles, each of the registration adjusting means including frequency converting means for multiplying or dividing the encoder clock signal to produce a first registration adjusting clock signal, start position delaying means for producing, from the first registration adjusting clock signal, a second registration adjusting clock signal which is delayed by a time corresponding to external variable instruction data from an original position pulse signal representative of an original position of the rotary drum, synchronizing means for producing, from the first picture element recording clock signal, a second picture element recording clock signal synchronized with the second registration adjusting clock signal and the exciting clock signal, a line buffer for storing picture image data therein and for being controlled in accordance with the second picture element recording clock signal to recall the stored data therefrom, controlling signal generating means for generating, from the second picture element recording clock signal, a loading signal delayed by a predetermined time, pulse width modulating means for receiving picture element data read out from the line buffer in response to the loading signal to output a pulse width modulating signal having a pulse width corresponding to the thus received picture image data, and high voltage switching means for voltage controlling the pulse width modulating signal to produce a controlling signal for the corresponding exciting means.

In the ink jet recording apparatus, the encoder clock generating means produces, from a rotary drum position signal representative of a rotational position of the rotary drum, an encoder clock signal including a predetermined number of clocks which divide a circumference of the rotary drum uniformly, and the dot clock generating means produces a first picture element recording clock signal in accordance with an external picture element density instruction from the encoder clock signal from the encoder clock generating means. The frequency converting means multiplies or divides the encoder clock signal from the encoder clock generating means to produce a first registration adjusting clock signal. The start position delaying means produces, from the first registration adjusting clock signal from the frequency multiplying means, a second registration adjusting clock signal which is delayed by a time corresponding to external variable instruction data from an original position pulse signal representative of an original position of the rotary drum. The synchronizing means produces, from the first picture element recording clock signal from the dot clock generating means, a second picture element recording clock signal synchronized with the second registration adjusting clock signal and the exciting clock signal. The line buffer stores picture image data therein and is controlled in accordance with the second picture element recording clock signal from the synchronizing means to recall the stored data therefrom, and the controlling signal generating means generates, from the second picture element recording clock signal from the synchronizing means, a loading signal delayed by a predetermined time. The pulse width modulating means receives picture element data read out from the line buffer in response to the loading signal from the controlling signal generating means and outputs a pulse width modulating signal having a pulse width corresponding to the thus received picture image data, and the high voltage switching means voltage controls the pulse width modulating signal from the pulse width modulating means to produce a controlling signal for the corresponding exciting means.

With the ink jet recording apparatus, adjustment in registration of the nozzles in a circumferential direction is performed using the first registration adjusting clock signal having a higher frequency than the first picture element recording clock signal produced with reference to the encoder clock signal. Accordingly, registration adjustment can be performed with a very high resolution. Further, since the controlling signal which is adjusted in accordance with the first registration adjusting lock signal so that recording head positions of the nozzles may overlap with each other are further synchronized with the exciting clock signal for the driving of the exciting means which controls disintegration of an ink jet, ink drops can be controlled individually, and consequently, high resolution recording can be achieved. Further, if the first registration adjusting clock signal is produced from the first picture element recording clock signal, then even if the first picture element recording clock signal varies, the resolution in registration adjustment remains constant for each dot pitch, that is, the resolution in registration adjustment=dot pitch/M (M is a fixed position integral number). Furthermore, since the first registration adjusting clock signal is produced from the encoder clock signal, even if the first picture element recording clock signal varies, the resolution in registration adjustment does not rely upon a dot pitch but remains fixed. In addition, the resolution in registration adjustment can be designated variably in accordance with an external signal from an MPU, a dip switch or the like.

According to a further aspect of the present invention, there is provided an ink jet recording apparatus of the continuous jet type, which comprises an electrically isolated conductive drop catcher, a current detector connected to the conductive drop catcher for detecting a jet current, and optimum phase determining means for determining an optimum phase relationship between disintegration of an ink jet and a recording pulse signal in accordance with a value of a jet current detected by the current detector.

In the ink jet recording apparatus of the continuous jet type, the current detector is connected to the electrically isolated conductive drop catcher and detects a jet current, and the optimum phase determining means determines an optimum phase relationship between disintegration of an ink jet and a recording pulse signal in accordance with a value of a jet current detected by the current detector.

With the ink jet recording apparatus of the continuous jet type, noises can be removed with certainty from a jet current with a very simple construction, and the jet current can be measured with a high degree of accuracy. Then the optimum phase relationship between disintegration of an ink jet and a recording pulse signal is automatically adjusted in accordance with a result of such measurement of the jet current. Consequently, ink drops can be controlled individually with certainty. Accordingly, drop noises which may otherwise be caused principally at a highlight portion of a recorded picture image by incompletely charged ink drops can be eliminated.

According to a still further aspect of the present invention, there is provided an ink jet recording apparatus of the continuous jet type, which comprises jet forming means including a nozzle for pressurizing ink to form a jet of such ink, oscillating means having an oscillation frequency at or around a spontaneous disintegrating frequency of an ink jet, delaying and exciting means for variably delaying an output of the oscillating means and exciting a vibrating element mounted on the nozzle in response to the delayed signal to cause an ink jet to be disintegrated into ink drops in synchronism with such excitation, charging means for selectively charging an ink drop, deflecting means for selectively producing a deflecting electric field and deflecting a charged ink drop when a deflecting electric field is produced but allowing a charged ink drop to advance straightforwardly when no deflecting electric field is produced, an electrically isolated conductive drop catcher, a current detector—connected to the electrically isolated conductive drop catcher for detecting a jet current, and optimum phase determining means for determining an optimum phase of the delaying and exciting means in response to a value of a jet current detected by the current detector.

In the ink jet recording apparatus of the continuous jet type, the jet forming means pressurizes ink to form a jet of such ink from the nozzle, and the delaying and exciting means variably delays an output of the oscillating means having an oscillation frequency at or around a spontaneous disintegrating frequency of an ink jet and excites the vibrating element mounted on the nozzle in response to the delayed signal to cause an ink jet to be disintegrated into ink drops in synchronism with such excitation. The charging means selectively charges an ink drop, and the deflecting means selectively produces a deflecting electric field and deflects a charged ink drop when a deflecting electric field is produced but allows a charged ink drop to advance straightforwardly when no deflecting electric field is produced. The current detector connected to the electrically isolated conductive drop catcher detects a jet current, and the optimum phase determining means determines an optimum phase of the delaying and exciting means in response to a value of a jet current detected by the current detector.

Also with the ink jet recording apparatus of the continuous jet type, noises can be removed with certainty from a jet current with a very simple construction, and the jet current can be measured with a high degree of accuracy. Then, the optimum phase relationship between disintegration of an ink jet and a recording pulse signal is automatically adjusted in accordance with a result of such measurement of the jet current. Consequently, ink drops can be controlled individually with certainty. Accordingly, drop noises which may otherwise be caused principally at a highlight portion of a recorded picture image by incompletely charged ink drops can be eliminated.

According to a yet further aspect of the present invention, there is provided an ink jet recording apparatus of the continuous jet type, which comprises jet forming means including a nozzle for pressurizing ink to form a jet of such ink, oscillating means having an oscillation frequency at or around a spontaneous disintegrating frequency of an ink jet, exciting means for exciting a vibrating element mounted on the nozzle in response to an output of the oscillating means to cause an ink jet formed from the jet forming means to be disintegrated into ink drops in synchronism with such excitation, delaying and charging means for variably delaying an output signal of the oscillating means and selectively charging an ink drop with the thus delayed signal, deflecting means for selectively producing a deflecting electric field and deflecting a charged ink drop when a deflecting electric field is produced but allowing a charged ink drop to advance straightforwardly when no deflecting electric field is produced, an electrically isolated conductive drop catcher, a current detector connected to the electrically isolated conductive drop catcher for detecting a jet current, and optimum phase determining means for determining an optimum phase of the delaying and charging means in response to a value of a jet current detected by the current detector.

In the an ink jet recording apparatus of the continuous jet type, the jet forming means pressurizes ink to form a jet of such ink from the nozzle, and the exciting means excites the vibrating element mounted on the nozzle in response to an output of the oscillating means having an oscillation frequency at or around a spontaneous disintegration frequency of an ink jet to cause an ink jet formed from the jet forming means to be disintegrated into ink drops in synchronism with such excitation. The delaying and charging means variably delays an output signal of the oscillating means and selectively charges an ink drop with the thus delayed signal, and the deflecting means selectively produces a deflecting electric field and deflects a changed ink drop when a deflecting electric field is produced but allows a charged ink drop to advance straightforwardly when no deflecting electric field is produced. The current detector connected to the electrically isolated conductive drop catcher detects a jet current, and the optimum phase determining means determines an optimum phase of the delaying and charging means in response to a value of a jet current detected by the current detector.

Also with the ink jet recording apparatus of the continuous jet type, noises can be removed with certainty from a jet current with a very simple construction, and the jet current can be measured with a high degree of accuracy. Then, the optimum phase relationship between disintegration of an ink jet and a recording pulse signal is automatically adjusted in accordance with a result of such measurement of the jet current. Consequently, ink drops can be controlled individually with certainty. Accordingly, drop noises which may otherwise be caused principally at a highlight portion of a recorded picture image by incompletely charged ink drops can be eliminated.

According to a yet further aspect of the present invention, there is provided an optimum phase determining method for an ink jet recording apparatus of the continuous jet type, which comprises the steps of jetting a jet of ink from a nozzle and thereafter holding a steady condition wherein such ink jet is jetted from the nozzle, the ink jet disintegrating into ink drops, successively applying probe pulses of successively displaced phases to a controlling electrode for controlling charging of the individual ink drops while successively measuring a jet current for such phases, letting the ink drops pass by a deflecting electrode while no deflecting electric field is formed by the deflecting electrode, and determining, based on thus measured values of the jet current, an optimum phase between disintegration of an ink jet and a recording pulse to be applied to the deflecting electrode for formation of a deflecting electric field.

In the optimum phase determining method for an ink jet recording apparatus of the continuous jet type, a jet of ink is jetted from a nozzle, and thereafter a steady condition wherein such ink jet is jetted from the nozzle is held. The ink jet disintegrates into ink drops. Probe pulses of successively displaced phases are successively applied to a controlling electrode for controlling charging of the individual ink drops while a jet current is successively measured for such phases. The ink drops are let pass by a deflecting electrode while no deflecting electric field is formed by the deflecting electrode, and an optimum phase between disintegration of an ink jet and a recording pulse to be applied to the deflecting electrode for formation of a deflecting electric field is determined based on thus measured values of the jet current.

With the optimum phase determining method, a jet current is measured with a high degree of accuracy, and the optimum phase relationship between disintegration of an ink jet and a recording pulse signal is automatically adjusted in accordance with a result of such measurement of the jet current. Consequently, ink drops can be controlled individually with certainty. Accordingly, drop noises which may otherwise be caused principally at a highlight portion of a recorded picture image by incompletely charged ink drops in an ink jet recording apparatus can be eliminated.

The above and other objects, features and advantages of the present invention will become apparent from the following description and appended claims, taken in conjunction with the accompanying drawings in which like parts or elements are denoted by like reference characters.

DESCRIPTION OF THE PREFERRED EMBODIMENTS

Figure 1:
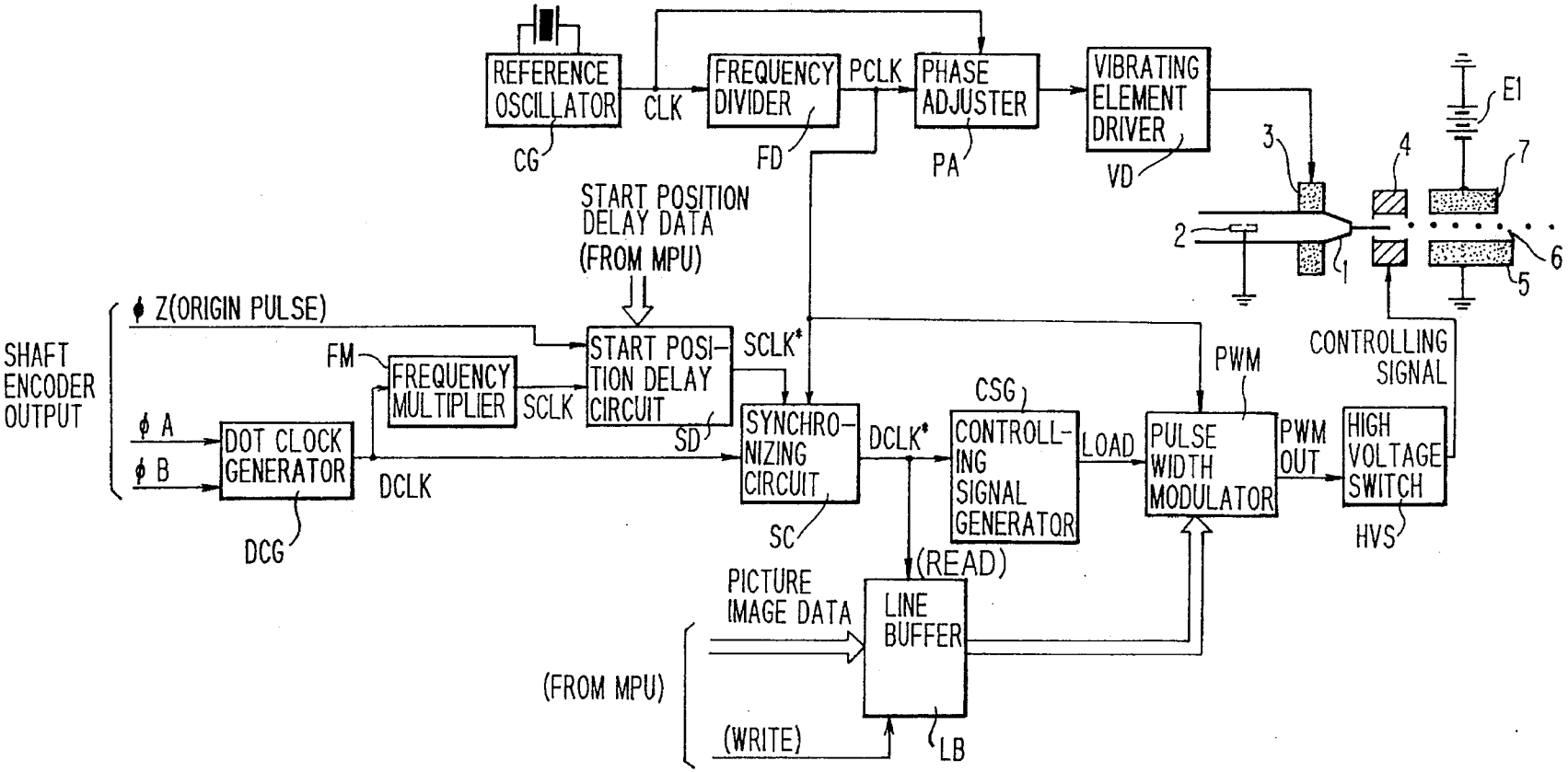
FIG. 1 is a diagrammatic representation of a continuous jet type ink jet recording apparatus showing a first preferred embodiment of the present invention.

As shown in FIG. 1, there is shown a continuous jet type ink jet recording apparatus to which the present invention is applied. The ink jet recording apparatus includes a continuous jet type ink jet recording head, a vibrating element driving circuit section and a controlling signal circuit section.

The continuous jet type ink jet recording head includes a nozzle 1 having a circular orifice (not shown) of a very small diameter, an ink electrode 2 for holding the potential of ink in the nozzle 1 at a ground level, a vibrating element 3 in the form of a piezoelectric vibrating element mounted on the nozzle 1, a controlling electrode 4 having a circular opening or a slit-like opening (uninumbered) coaxial with the nozzle 1 for receiving a controlling signal to control charging of a jet of ink in response to picture image data, a grounding electrode 5 disposed in front of the controlling electrode 4 and grounded itself, a knife edge 6 mounted on the grounding electrode 5, a deflecting power source El, and a deflecting electrode 7 connected to the deflecting power source E1 for cooperating with the grounding electrode 5 to produce therebetween an intense electric field perpendicular to an ink jet flying axis to deflect a charged ink drop to the grounding electrode 5 side.

The vibrating element driving circuit section includes a reference oscillator CG for generating a reference clock signal CLK, a frequency divider FD for frequency dividing such reference clock signal CLK at a dividing ration N (positive integer) to produce an exciting clock signal PCLK, a phase adjuster PA for receiving such exciting clock signal PCLK, producing, in response to the reference clock signal CLK, output signals which are successively delayed by $2\pi/N$ from the received exciting clock signal PCLK for one period of the exciting clock signal PCLK and outputting a suitable one of such output signals, and a vibrating element driver VD for amplifying an output of the phase adjuster PA to drive the vibrator 3. The vibrating element driving frequency is equal to a frequency of the exciting clock signal PCLK.

The controlling signal circuit section includes a dot clock generator DCG for producing a picture element recording clock signal DCLK from outputs $\phi A$ and $\phi B$ of a shaft encoder (not shown) (each of such outputs will be hereinafter referred to as shaft encoder output) connected to a shaft of a rotary drum (not shown) on which a record medium is supported, a frequency multiplier FM for receiving the picture element recording clock signal DCLK and producing a registration adjusting clock signal SCLK having a frequency equal to an integral number of times that of the received picture element recording clock signal DCLK, a start position delay circuit SD for delaying the registration adjusting clock signal SCLK by a fixed interval of time based on start position delay data received from an MPU (not shown) with respect to another shaft encoder output $\phi Z$ (origin pulse) to produce a registration adjusting clock signal SCLK*, a synchronizing circuit SC for receiving the picture element recording clock signal DCLK and producing a picture element recording clock signal DCLK* having rising and falling edges synchronized with the registration adjusting clocks SCLK* and exciting clocks PCLK, and a line buffer LB having a storage capacity corresponding to one full rotation of the rotary drum. The controlling signal circuit section further includes a controlling signal generator CSG for producing, from the picture element recording clock DCLK*, a loading signal LOAD delayed by a fixed interval of time from the picture element recording clock DCLK*, a pulse width modulator PWM into which picture element data outputted from the line buffer LB are loaded in response to the loading signal LOAD and which produces a pulse width modulating signal PWMOUT having a pulse width which increases in proportion to the thus loaded picture image data, and a high voltage switch HVS for voltage amplifying the pulse width modulating signal PWMOUT to produce a controlling signal to be applied to the controlling electrode 4.

It is to be noted that only those elements which relate to a single nozzle for a single color are shown in FIG. 1, and the continuous jet type ink jet recording apparatus actually includes four (C, M, Y and BK) or three (C, M and Y) such nozzles provided independently of each other therein together with associated elements except that the references oscillator CG and dot clock generator DCG are provided commonly to the nozzles. Also the deflecting power source E1, deflecting electrode 7, grounding electrode 5 and knife edge 6 may otherwise be provided commonly to the nozzles.

Figure 2:
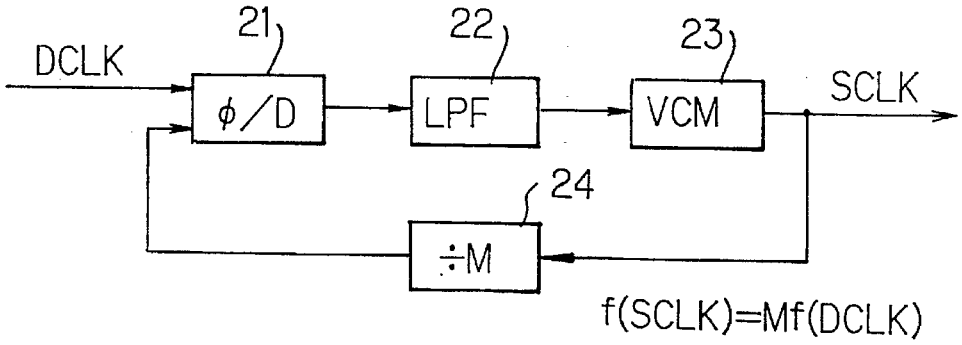
FIG. 2 is a block diagram showing a phase-locked loop serving as a frequency multiplier of the ink jet recording apparatus of FIG. 1.

As shown in FIG. 2, the frequency multiplier FM is constructed, for example, from such a PLL (phase-locked loop) which produces, using a picture element recording clock signal DCLK as a reference signal, a registration adjusting clock signal SCLK phase-locked with the picture element recording clock signal DCLK and having a frequency equal to M times that of the picture element recording clock signal DCLK. The frequency multiplier FM is composed of a phase comparator ($\phi$/D) 21, a low-pass filter (LPF) 22, a voltage controlled oscillator (VCM) 23, and a frequency divider (÷M) 24 having a frequency dividing ratio M (a positive integer).

Figure 3:
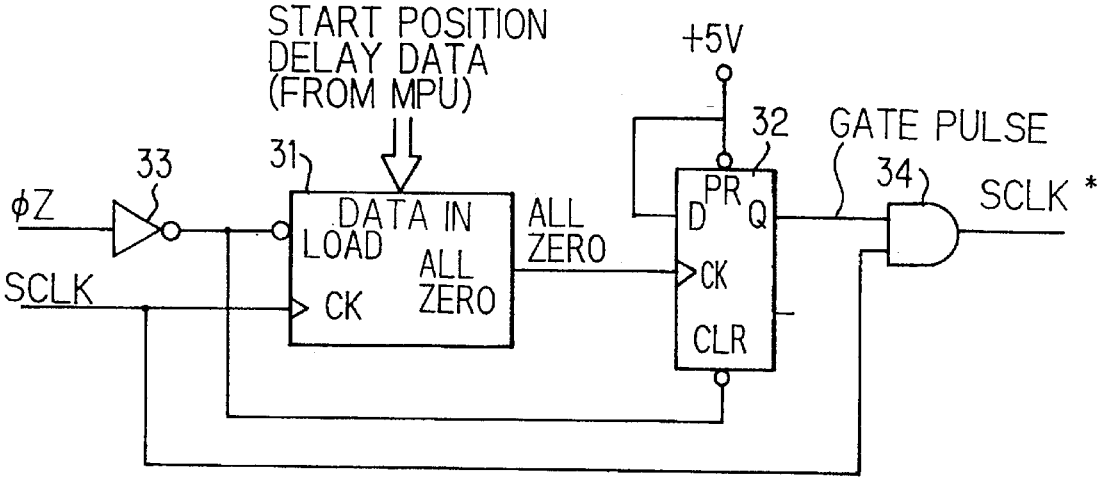
FIG. 3 is a block diagram showing a start position delay circuit of the ink jet recording apparatus of FIG. 1.
Figure 4:
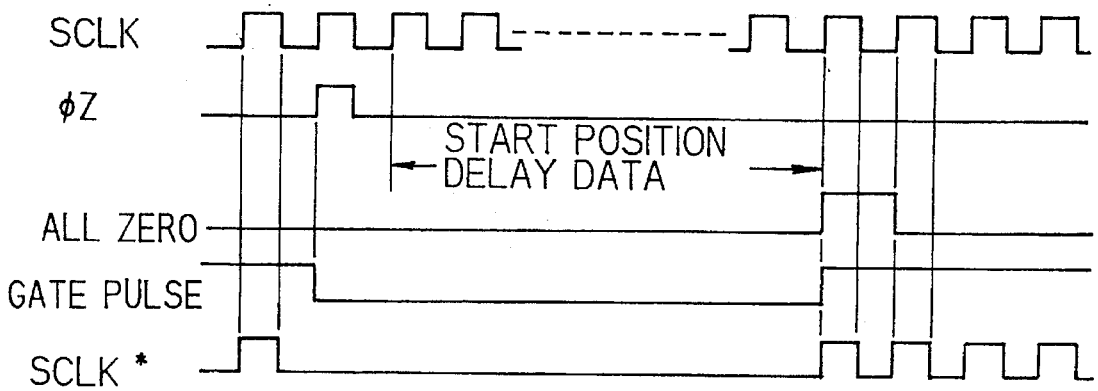
FIG. 4 is a timing chart illustrating operation of the start position delay circuit of FIG. 3.

Ash shown in FIG. 3, the start position delay circuit SD is constructed, for example, from a preset decrementing counter 31, a delay type flip-flop 32, an invertor 33 and an AND gate 34. In the start position delay circuit SD, the preset decrementing counter 31 is loaded with start position delay data, which increase in proportion to a delay time, in response to a shaft encoder output $\phi Z$ (origin pulse) and is decremented in response to a registration adjusting clock signal SCLK as seen from FIG. 4. When the count value of the present decrementing counter 31 is decremented finally to "ALL ZERO", a rising signal GATEPULSE is produced by the delay type flip-flop 32. Such rising signal GATEPULSE and the registration adjusting clock SCLK are ANDed by the AND gate 34 to obtain a registration adjusting clock SCLK.*

Figure 5:
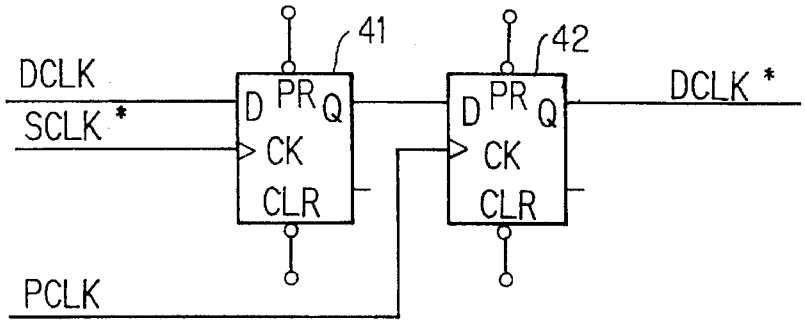
FIG. 5 is a block diagram showing a synchronizing circuit of the ink jet recording apparatus of FIG. 1.
Figure 6:
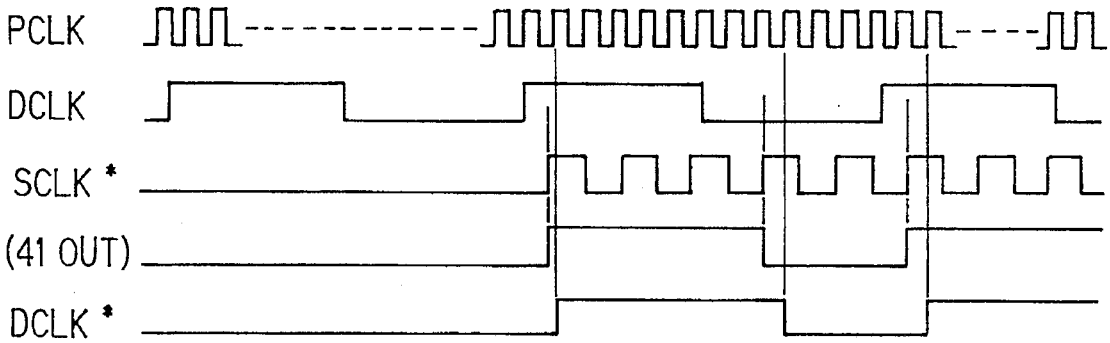
FIG. 6 is a timing chart illustrating operation of the synchronizing circuit of FIG. 5.

Referring now to FIG. 5, the synchronizing circuit SC is constructed, for example, from a pair of delay type flip-flops 41 and 42. In the synchronizing circuit SC, a picture element recording clock DCLK* is produced which has rising and falling edges synchronized with rising edges of a registration adjusting clock SCLK* and an exciting clock PCLK, respectively, as seen from FIG. 6.

The line buffer LB in constructed using, for example, a RAM (random access memory) or a FIFO (first-in first-out) memory.

Figure 7:
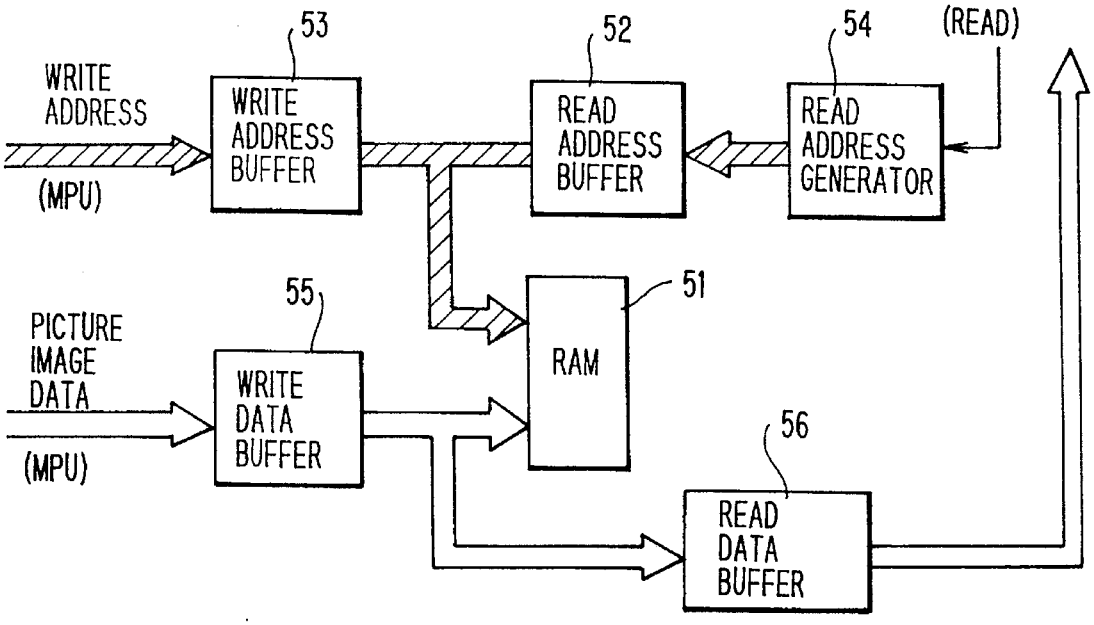
FIG. 7 is a block diagram showing a line buffer of the ink jet recording apparatus of FIG. 1 where a RAM is employed therefor.

(1) Where a RAM is employed, the line buffer LB is constructed from, as shown in FIG. 7, a RAM 51, a read address buffer 52, a write address buffer 53, a read address generator 54, a write data buffer 55 and a read data buffer 56. In the line buffer LB, picture image data from the MPU are written into the RAM 51 by way of the write data buffer 55. Then, the read address generator 54 counts a picture element recording clock DCLK* (READ) to produce an address signal, which is incremented by each such picture element recording clock DCLK*, and such address signal is transmitted to the RAM 51 by way of the read address buffer 52 to designate an address of the RAM 51. Consequently, picture element data at the address of the RAM 51 are read out and transmitted to the read data buffer 56. Though not particularly shown, opening or closing of each of the address buffers 52 and 53 and data buffers 55 and 56 is controlled by the MPU.

Figure 8:
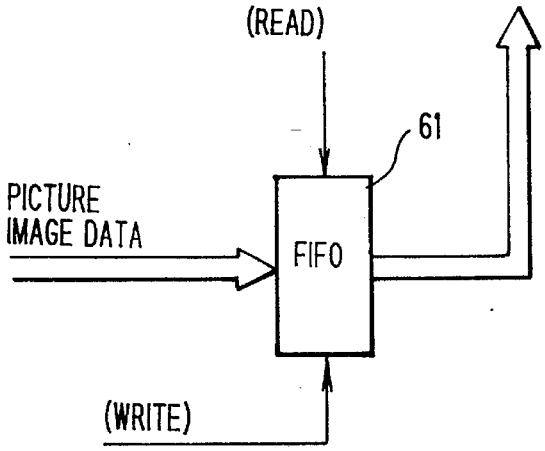
FIG. 8 is a block diagram showing the line buffer of the ink jet recording apparatus of FIG. 1 where a FIFO (first-in/first-out) memory is employed therefor.

(2) On the other hand, where a FIFO memory is employed for the line buffer LB, since it is not necessary to designate an address, it is connected in such a manner as shown in FIG. 8. In particular, picture element data are written in an order into the FIFO memory 61 by the MPU and then read out from the FIFO memory 61 in response to a picture element recording clock signal DCLK* (READ) in the same order.

It is to be noted that a pair of such line buffers LB are provided for each of the nozzles 1 and writing and reading are performed alternatively for the paired line buffers LB each time the rotary drum makes one full rotation. In other words, when writing is performed for one of each paired line buffers LB, reading is performed for the other line buffer LB.

Figure 9:
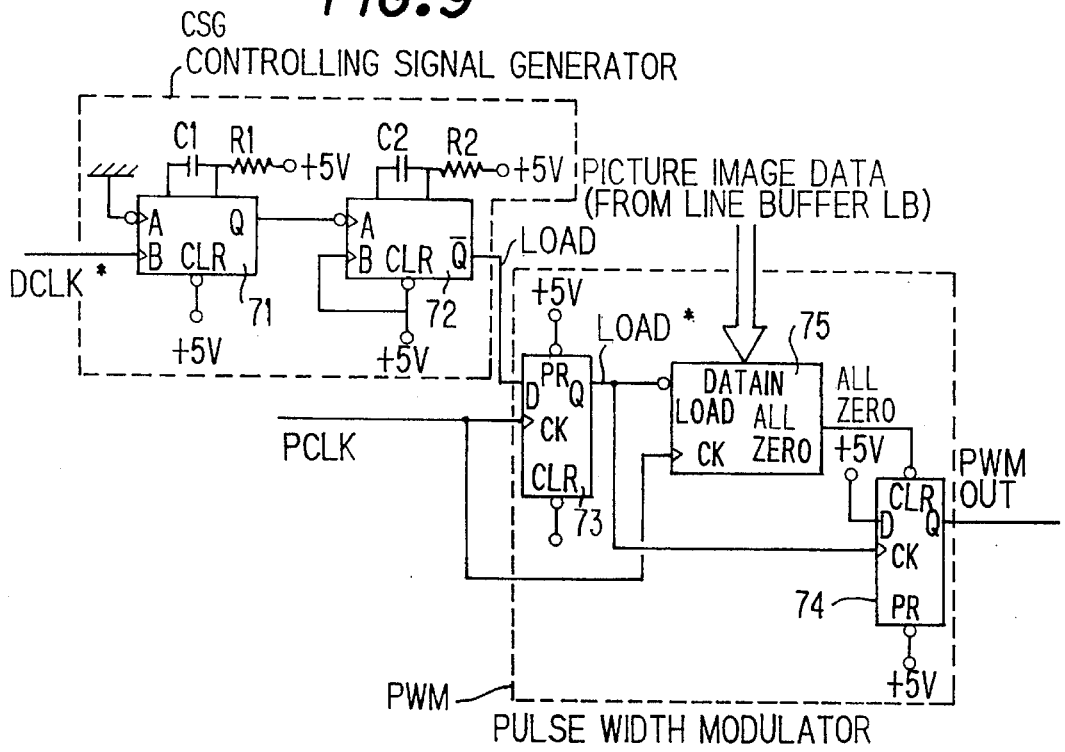
FIG. 9 is a block diagram showing a controlling signal generator and a pulse width modulator of the ink jet recording apparatus of FIG. 1.
Figure 10:
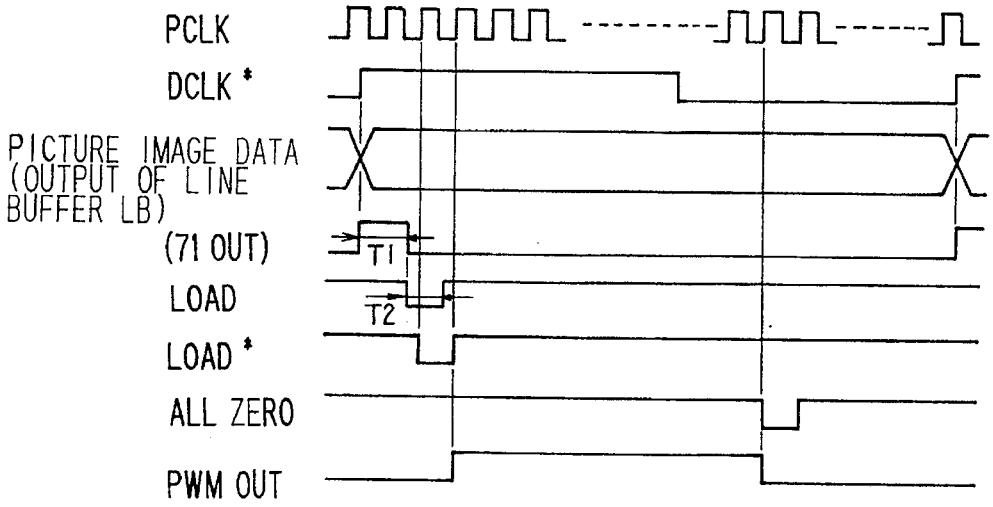
FIG. 10 is a timing chart illustrating operation of the controlling signal generator and pulse width modulator of FIG. 9.

As shown in FIG. 9, the controlling signal generator CSG is constructed, for example, from a pair of delay circuits which operate in response to a picture element recording clock signal DCLK*. Each of the delay circuits is constructed from a pair of monostable multivibrators 71 and 72, a pair of capacitors C1 and C2 and a pair of resistors R1 and R2. In the controlling signal generator CSG, a delay time from a rising edge of a picture element recording clock DCLK* to a loading signal LOAD is set equal to an interval of time until picture element data of a line buffer LB read out in response to a picture element recording clock DCLK* is settled on an output data bus as seen from FIG. 10.

The pulse width modulator PWM is constructed, for example, from a pair of delay type flip-flops 73 and 74 and a preset decrementing counter 75. In the pulse width modulator PWM, since an exciting clock signal PCLK and a loading signal LOAD are generally in an asynchronous condition as seen from FIG. 10, the loading signal LOAD is first synchronized with the exciting clock signal PCLK by the delay type flip-flop PCLK to produce a loading signal LOAD*. Subsequently, the loading signal LOAD is inputted as a loading signal for picture image data to the preset decrementing counter 75 and inputted also to the delay type flip-flop 74. Consequently, the delay type flip-flop 74 produces a pulse width modulating signal PWMOUT which rises in response to a rising edge of the loading signal LOAD*. After then, picture image data are counted down by the preset decrementing counter 75 in response to the exciting clock signal PCLK, and when the count value of the preset decrementing counter 75 is reduced finally to "ALL ZERO", a falling signal ALLZERO is outputted from the preset decrementing counter 75. In response to such falling signal ALLZERO, the output of the delay type flip-flop 74, that is, the pulse width modulating signal PWMOUT, falls, thereby ending the conversion of the picture image data into a pulse width.

Referring back to FIG. 1, in operation, the dot clock generator DCG produces a picture element recording clock signal DCLK from an output of the shaft encoder. Each of the frequency multipliers FM multiplies a frequency of the picture element recording clock signal DCLK to produce a registration adjusting clock signal SCLK.

Meanwhile, start position delay data which have been measured for each of the nozzles 1 so that registration of the nozzle 1 in a drum circumferential direction may be established are loaded into the start position delay circuit SD corresponding to the nozzle 1.

The corresponding start position delay circuit SD delays the registration adjusting clock signal SCLK in accordance with the start position delay data from the MPU with reference to an origin pulse (ϕZ) of the shaft encoder to a time tolerance with which a registration adjusting resolution corresponds to recording picture element pitch/M to obtain a registration adjusting clock signal SCLK*.

The synchronizing circuit SC receives a exciting clock signal PCLK, the registration adjusting clock signal SCLK* and the picture element recording clock signal DCLK and produces a picture element recording clock signal DCLK* which is delayed by an interval of time corresponding to the start position delay data from the picture element recording clock signal DCLK and synchronized with the exciting clock signal PCLK, that is, with production of an ink drop.

Picture element data written in the line buffer LB are read out in response to the picture element recording clock signal DCLK*.

Meanwhile, the controlling signal generator CSG delays the picture element recording clock signal DCLK* by a predetermined interval of time to produce a loading signal LOAD.

The pulse width modulator PWM is loaded in response to the loading signal LOAD with the picture image data read out from the line buffer LB and produces, in synchronism with the exciting clock signal PCLK, a pulse width modulating signal PWMOUT having a pulse width corresponding to the picture image data loaded therein.

The high voltage switch HVS voltage controls the pulse width modulating signal PWMOUT to form a charging controlling signal for an ink drop.

As described hereinabove, the continuous jet type ink jet recording apparatus has a registration adjusting resolution equal to a fraction of an integral number of a recording picture element pitch. For example, if the recording picture element pitch is 1/16 mm (picture element density is 400 dpi) and the frequency dividing ration M of the frequency multiplier FM is M=6, then registration adjustment can be performed to a tolerance of about 10 μm. If the recording picture element pitch varies, then also the registration adjusting resolution varies.

Meanwhile, if the frequency multiplier FM is formed from a PLL and a programmable counter is employed for the frequency divider 24 (FIG. 7) so that the frequency dividing ratio thereof may be set by the MPU, then the registration adjusting resolution can be set variable. It is to be noted that such variable setting of the registration adjusting resolution can be attained even if the frequency dividing ratio of the frequency multiplier FM is varied in accordance with an input otherwise from a dip switch or the like.

Figure 11:
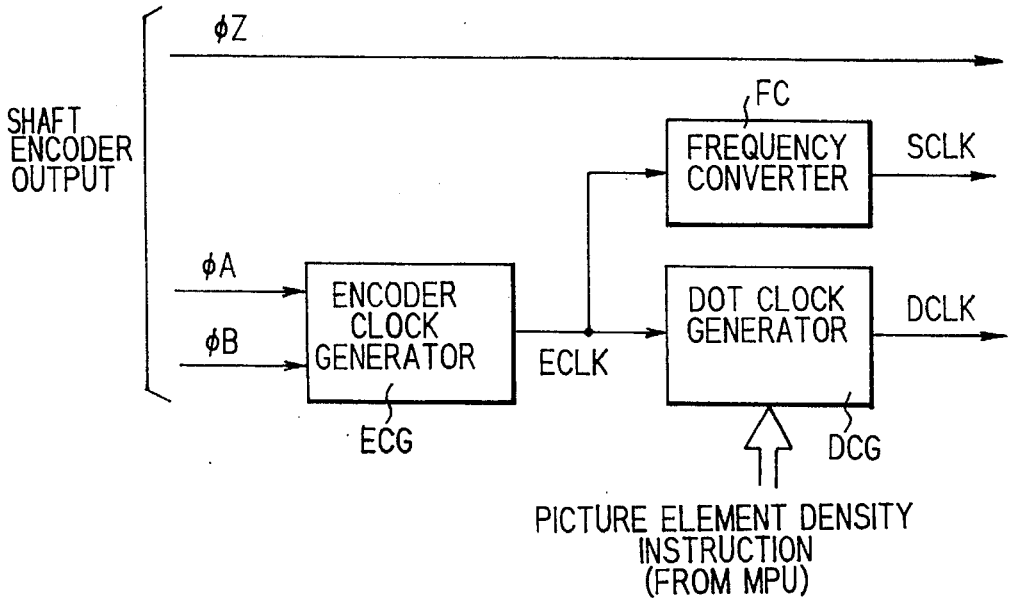
FIG. 11 is a block diagram showing a modification to the ink jet recording apparatus of FIG. 1.
Figure 15:
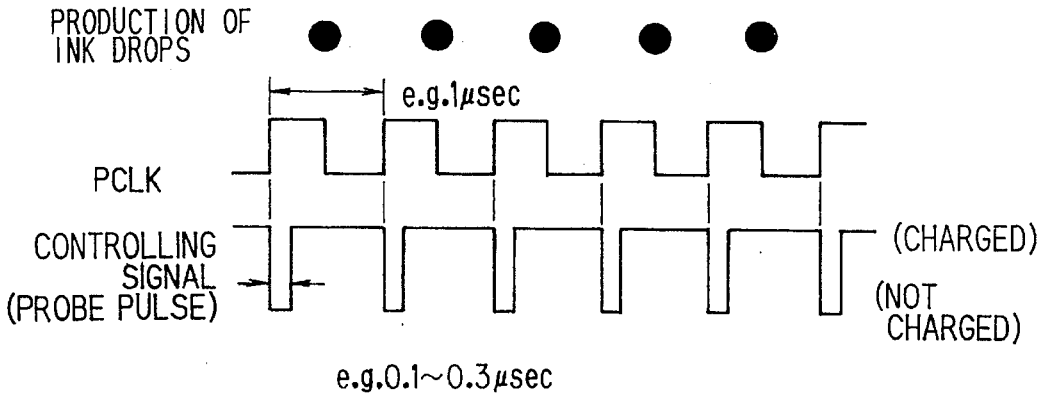
FIG. 15 is a timing chart illustrating a relationship among production of ink drops, an exciting signal and a controlling signal (probe pulse signal) in the ink jet recording apparatus of FIG. 13.

As shown in FIG. 11, there is shown a modified portion of the continuous jet type ink jet recording apparatus of FIG. 1. The modified ink jet recording apparatus includes, in place of the dot clock generator DCG and the frequency multiplier FM described above, an encoder clock generator ECG for receiving a pair of shaft encoder outputs ϕA and ϕB and producing an encoder clock signal ECLK having a fixed number of pulses per one full rotation of the rotary drum from the thus received shaft encoder outputs ϕA and ϕB, a dot clock generator DCG for receiving such encoder clock signal ECLK and producing a variable picture element recording clock signal DCLK in accordance with a picture element density instruction from the MPU, and a frequency converter FC for receiving and multiplying or dividing the encoder clock signal ECLK to produce a registration adjusting clock signal SCLK.

With the modified ink jet recording apparatus, the encoder clock generator ECG produces, from the outputs ϕA and ϕB of the shaft encoder connected to the shaft of the rotary drum, an encoder clock signal ECLK which uniformly divides a circumference of the rotary drum.

The dot clock generator DCG produces a picture element recording clock signal DCLK from the encoder clock signal ECLK received from the encoder clock generator ECG in accordance with a picture element density instruction from the MPU.

The frequency converter FC multiplies or divides the encoder clock signal ECLK from the encoder clock generator ECG to produce a registration adjusting clock signal SCLK.

While the registration adjusting resolution varies, in the continuous jet type ink jet recording apparatus of FIG. 1, in proportion to a recording picture element pitch which depends upon a picture element recording clock signal DCLK, the registration adjusting resolution of the modified continuous jet type ink jet recording apparatus always remains fixed. In particular, since a registration adjusting clock signal SCLK is produced by multiplying or dividing an encoder clock signal ECLK which divides a circumference of the rotary drum, a necessary registration adjusting resolution is determined such that it may be obtained always as a fixed value.

Figure 12:
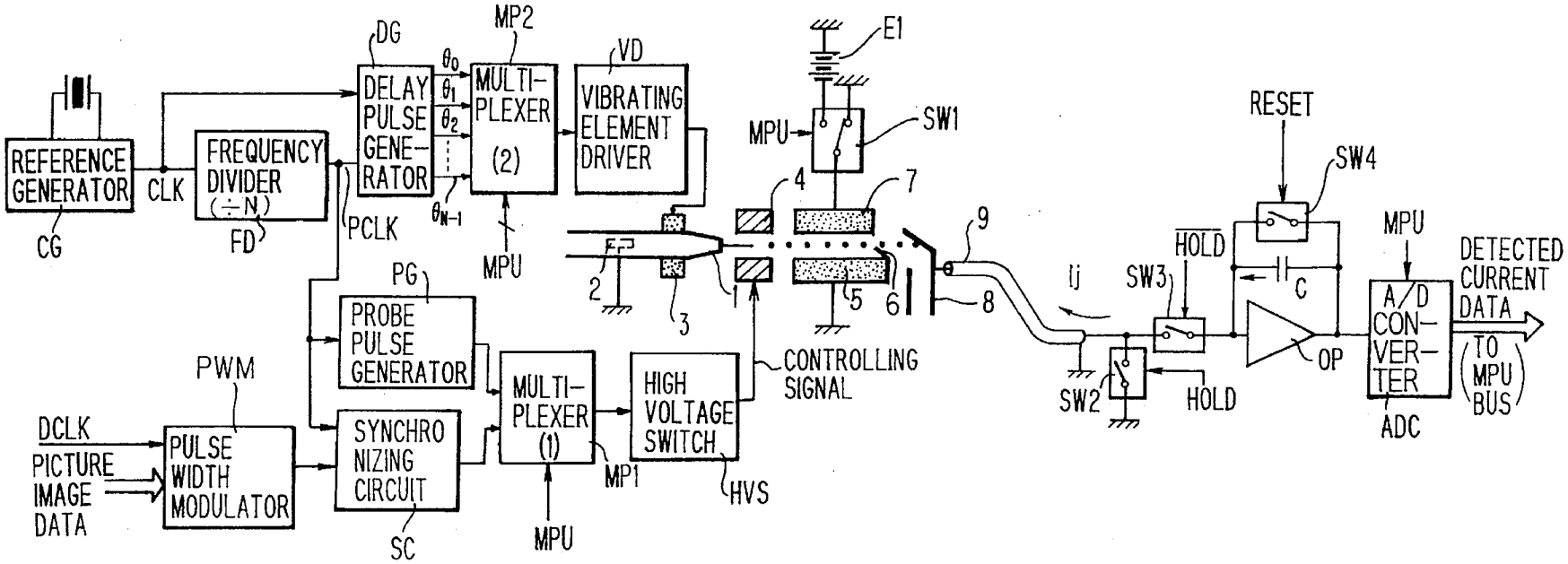
FIG. 12 is a block diagram of another ink jet recording apparatus showing a second preferred embodiment of the present invention.

As shown in FIG. 12, there is shown another continuous jet type ink jet recording apparatus to which the present invention is applied. The ink jet recording apparatus includes a nozzle 1 having a circular orifice (not shown) of a very small diameter, an ink electrode 2 for holding the potential of ink in the nozzle 1 at a ground level, a vibrating element 3 in the form of a piezoelectric vibrating element mounted on the nozzle 1, a controlling electrode 4 having a circular opening or a slit-like opening coaxial with the nozzle 1 for receiving a controlling signal to control charging of a jet of ink in response to picture image data, a grounding electrode 5 disposed in front of the controlling electrode 4 and grounded itself, a knife edge 6 mounted on the grounding electrode 5, a deflecting power source El, a deflecting electrode 7 connected to the deflecting power source E1 for cooperating with the grounding electrode 5 to produce therebetween an intense electric field perpendicular to an ink jet flying axis to deflect a charged ink drop to the grounding electrode 5 side, a switch SW1 for alternatively connecting the deflecting electrode 7 to the deflecting power source E1 or the ground, a reference oscillator CG for generating a reference clock signal CLK, a frequency divider FD for frequency dividing such reference clock signal CLK into one N-th (N is a positive integer) to produce an exciting clock signal PCLK, a delay pulse generator DG for successively delaying the exciting clock signal PCLK to N stages in response to the reference clock signal CLK to produce a train of pulses $\theta_0$, $\theta_1$, $\theta_2$, . . . and $\theta_{n-1}$, a multiplexer (2) MP2 for selecting one of the delayed pulses $\theta_0$, $\theta_1$, $\theta_3$, . . . and $\theta_{N-1}$, a vibrating element driver VD for driving the vibrator 3 in response to a pulse selected by the multiplexer (2) MP2, a pulse width modulator PWM for converting picture image data into a pulse width corresponding to a density gradation, a probe pulse generator PG for producing, in synchronism with a rising or falling edge of the exciting clock signal PCLK, a probe pulse having a sufficiently small pulse width comparing with a period of the exciting clock signal PCLK, a synchronizing circuit SC for synchronizing a rising or falling edge of an output of the pulse width modulator PWM with a rising or falling edge of the exciting clock signal PCLK, another multiplexer (1) MP1 for selecting one of a probe pulse from the probe pulse generator PG and an output of the synchronizing circuit SC, a high voltage switch HVS for voltage amplifying an output of the multiplexer (1) MP1 to produce a controlling signal to be applied to the controlling electrode 4, a conductive drop catcher 8 disposed at a location (hereinafter referred to as home position) forwardly of the grounding electrode 5 and deflecting electrode 7 and serving also as a detecting electrode, a shield line 9 having an end connected to the conductive drop catcher 8, a current detector or current to voltage converter composed of three switches SW2, SW3 and SW4, an integrating capacitor C and an integrator OP, and an analog to digital (A/D) converter ADC for converting an output of the current detector from an analog signal into a digital signal.

The delay pulse generator DG is constructed, for example, from a serial-in parallel-out type N-bit shift register.

The probe pulse generator PG is constructed, for example, from a monostable multivibrator which is triggered by an edge of an exciting clock signal PCLK.

The integrating capacitor C suitably has a capacitance of 1 to 10 nF or so and preferably has a high insulation resistance such as a polystyrol or polypropylene capacitor.

The integrator OP is constructed from an operational amplifier of an FET (field effect transistor) input with which a leak current (less than 1 na) can be ignored comparing with a jet current Ij, and the input thereof is connected to a virtual grounding point thereof.

Also the switches SW2, SW3 and SW4 are each constructed from an FET with which a leak current can be ignored comparing with the jet current Ij.

Figure 13:
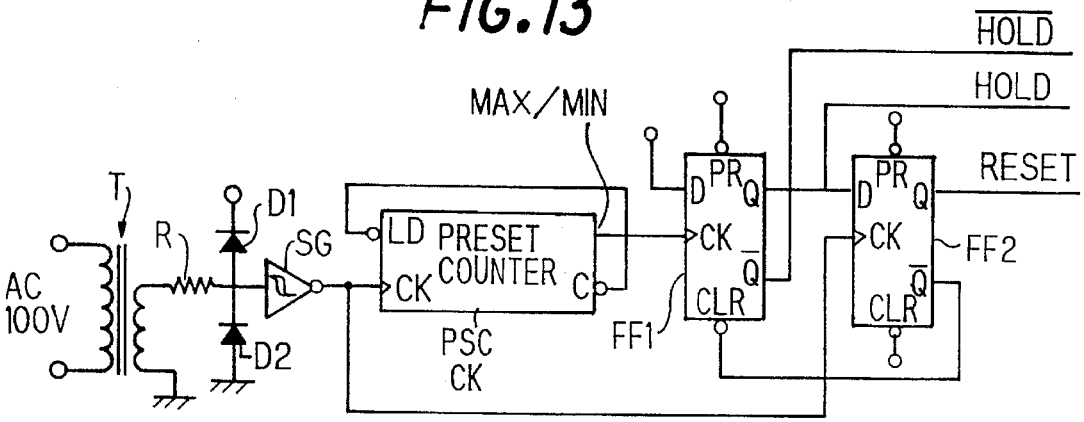
FIG. 13 is a block diagram of a synchronizing signal generating circuit for generating a synchronizing signal for the synchronous control of a current detector of the ink jet recording apparatus of FIG. 12.

As shown in FIG. 13, there is shown a synchronizing signal generating circuit for generating a synchronizing signal to cause the switches SW2, SW3 and SW4 to operate in synchronism with commercial power supply of, for example, ac 100 V. The synchronizing signal generating circuit is composed of a transformer T, a resistor R, a pair of diodes D1 and D2, a preset counter PSC, a pair of flip-flops FF1 and FF2.

The preset counter PSC can be set to a variable preset value by way of a route not shown, and the integration time of the integrator OP can be arbitrarily set to a value an integral number of times the period of the commercial power supply of ac 100 V by changing such preset value of the preset counter PSC. In the present continuous jet type ink jet recording apparatus, the integration time is set to three times the period of the commercial power supply of ac 100 V as seen from FIG. 14.

A reset signal RESET, an integration starting signal $\overline{\text{HOLD}}$ and an integration ending signal HOLD are produced from the synchronizing signal generating circuit. Such reset signal RESET, integration starting signal $\overline{\text{HOLD}}$ and integration ending signal HOLD are fixed to one period of the commercial power supply of ac 100 V, and when they present a high ("H") level, the switches SW4, SW3, and SW2 are closed, but when they present a low ("L") level, the switches SW4, SW3 and SW2 are open, respectively.

In operation, when power is made available to the continuous jet type ink jet recording apparatus, an operating voltage is supplied to the circuit system shown in FIGS. 12 and 13, whereupon the circuit system starts its operation. First, a phase adjusting operation is performed. It is to be noted that such phase adjusting operation is normally performed when a carriage (not shown) on which the nozzle 1 is carried is positioned at its home position and immediately before a recording operation is started. Where the continuous jet type ink jet recording apparatus is constructed as a color ink jet printer, it includes four or three such nozzles 1 for four colors (C (cyan), M (magenta), Y (yellow) and BK (black)) or three colors (C, M and Y) and a phase adjusting operation is performed in parallel (i.e., concurrently) for the four or three nozzles 1.

First, ink is pressurized by an ink pump (not shown) and introduced into the nozzle 1 by way of an ink tube (not shown). Consequently, an ink jet is jetted from the nozzle 1, and the nozzle 1 is thereafter kept in such steady condition wherein an ink jet is being jetted. Meanwhile, an MPU (not shown) changes over the switch SW1 to the grounding side to change the level of the deflecting electrode 7 to a ground level. Consequently, the deflecting electric field between the grounding electrode 5 and deflecting electrode 7 disappears. Consequently, also a charged ink drop can pass by the knife edge 6. Further, the MPU controls the multiplexer (1) MP1 to select an output of the probe pulse generator PG. Furthermore, the carriage on which the nozzle 1 is carried is set to the home position by a carriage motor (not shown).

Meanwhile, the reference oscillator CG develops a reference clock signal CLK, and such reference clock signal CLK is divided in frequency into one N-th (1/N) by the frequency divider FD thereby to form an exciting pulse signal PCLK. Such exciting pulse signal PCLK has an exciting frequency PCLK (in the following description, a signal and a frequency of such signal are denoted by a same reference character) given by CLK/N. For example, when the reference clock frequency CLK is CLK=16 MHz and the dividing ratio N of the frequency divider FD is N=16, the exciting signal frequency PCLK is PCLK=1 MHz (=16/16). The exciting pulse signal PCLK outputted from the frequency divider FD is inputted to the delay pulse generator DG, probe pulse generator PG and synchronizing circuit SC.

The delay pulse generator DG receives the exciting clock signal PCLK as data and the reference clock signal CLK as a shift clock signal and outputs a train of N pulses $\theta_0$, $\theta_1$, $\theta_2$, . . . and $\theta_{N-1}$ having a same period as the exciting clock signal PCLK but having phases delayed successively by $2\pi/N$ from the exciting clock signal PCLK. One of the N pulses $\theta_0$, $\theta_1$, $\theta_2$, . . . and $\theta_{N-1}$ is selected by the MPU by way of the multiplexer (2) MP2 and transmitted to the vibrating element driver VD. The vibrating element driver VD excites the vibrating element 3 in response to an output signal of the multiplexer (2) MP2. Consequently, a jet of ink jetted from the nozzle 1 is disintegrated into ink drops in synchronism with such excitation of the vibrating element 3.

Figure 16:
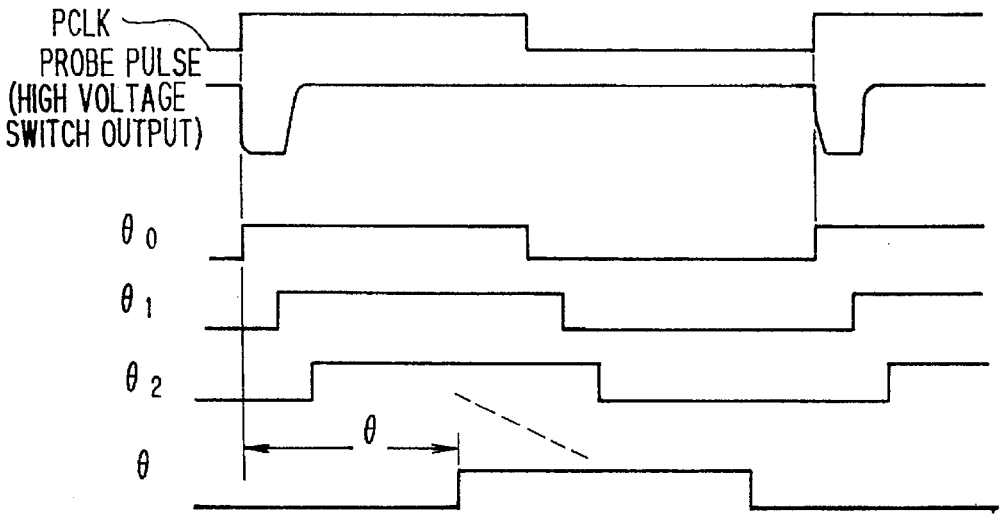
FIG. 16 is a timing chart illustrating a phase relationship between a probe pulse signal and an exciting signal in the ink jet recording apparatus of FIG. 13.

The probe pulse generator PG generates, in a synchronized relationship with a rising or falling edge (which is same as that upon recording) of the exciting clock signal PCLK, such a probe pulse having a pulse width sufficiently short comparing with a period of the exciting clock signal PCLK as seen in FIG. 16. For example, when the exciting clock signal PCLK has a period of 1 μsec (oscillated at 1 MHz), the pulse width of the probe pulse from the probe pulse generator PG is 0.1 to 0.3 μsec.

Figure 14:
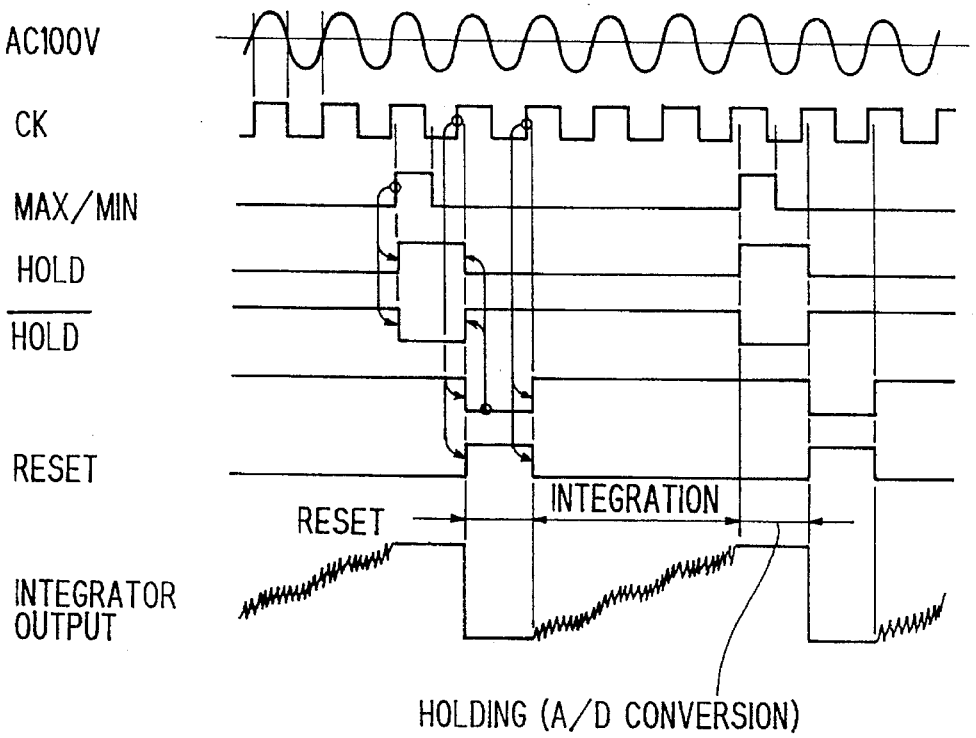
FIG. 14 is a timing chart illustrating operation of the synchronizing signal generating circuit of FIG. 13.

The probe pulse outputted from the probe pulse generator PG is inputted by way of the multiplexer (1) MP1 to the high voltage switch HVS, at which it is voltage amplified to form a controlling signal, and such controlling signal is applied to the controlling electrode 4. Accordingly, a drop of ink disintegrated in synchronism with excitation of the vibrating element 3 is charged in response to such probe pulse. When the continuous jet type ink jet recording apparatus operates in such a manner as illustrated in FIG. 14, an ink drop is always charged, but a charging voltage is removed only while a probe pulse is applied as a controlling signal to the controlling electrode 4 (for example, for 0.1 to 0.3 μsec).

Since the deflecting electric field is not present, even a charged ink drop is not deflected and passes by the knife edge 6 so that it is caught by the conductive drop catcher 8 located at the home position and electrically isolated from the other electric components.

Charge of charged ink drops caught by the conductive drop catcher 8 is inputted as a jet current Ij to the current detector, which is composed of the switches SW2, SW3 and SW4, integrating capacitor C and integrator OP, by way of the shield line 9, so that it is integrated for a fixed period of time by the integrator OP. The thus integrated charge appears as a voltage across the integrating capacitor C.

The switches SW2, SW3 and SW4 operate in synchronism with the commercial power supply of ac 100 V in order to remove noises included in the commercial power supply of ac 100 V and any other noises from an input current to the integrator OP so that only the jet current Ij may be integrated by the integrator OP and transmitted to the A/D converter ADC.

More particularly, in the synchronizing signal generating circuit shown in FIG. 13, the commercial power supply of ac 100 V is stepped down by the transformer T and clamped at 0 V and 5 V by the serially connected diodes D1 and D2, and a thus clamped signal is supplied to a Schmitt gate SG, at which a clock signal Ck of a TTL (transistor-transistor logic) level synchronized with the commercial power supply of ac 100 V is produced. From the clock signal CK, such an integration ending signal HOLD, an integration starting signal $\overline{\text{HOLD}}$ and a reset signal RESET as shown in FIG. 14 are produced by the preset counter PSC and flip-flops FF1 and FF2.

When the reset signal RESET changes from a low level to a high level, the switch SW4 is closed to short-circuit the integrating capacitor C. Consequently, the output of the integrator OP is reset to 0 V.

When the reset signal RESET changes from a high level to a low level after one period of the commercial power supply of ac 100 V, the switch SW4 is opened. Since the integration ending signal HOLD is at a low level (the switch SW2 is open) and the integration starting signal $\overline{\text{HOLD}}$ is at a high level (the switch SW3 is closed) then, the jet current Ij will thereafter flow into a virtual grounded point of the operational amplifier constituting the integrator OP, thereby starting an integrating operation of the integration OP.

When an interval of time equal to the predetermined integral number of times (three times in the case shown in FIG. 14) the period of the commercial power supply of ac 100 V elapses after starting of such integrating operation, the integration ending signal HOLD changes from a low level to a high level so that the switch SW2 is closed while the integration starting signal $\overline{\text{HOLD}}$ changes from a high level to a low level so that the switch SW3 is opened. Consequently, the jet current Ij is interrupted, and the jet current Ij which has been integrated by the integrating capacitor C till then is thereafter held as a voltage output of the integrator OP. Now, since an ink jet is charged in accordance with a controlling signal (probe pulse) applied to the controlling electrode so that it may have a negative charge, the jet current Ij flows in the direction indicated by an arrow mark in FIG. 12 into the integrating capacitor C, and the output of the integrator OP presents a high voltage.

By the way, it is almost impossible with an actual machine to perfectly shield a route between the conductive drop catcher 8 to the integrator OP from noises. Therefore, during an integrating operation, noises included in the commercial power supply of ac 100 V and high frequency noises produced from peripheral electronic appliances are overlapped in an output of the integrator OP. Among such noises, high frequency noises are averaged and do not matter because the integrating time is longer than one period of the commercial power supply of ac 100 V and sufficiently long. Meanwhile, noises of the commercial power supply of ac 100 V are averaged during an integrating period and accordingly are removed automatically since the integrating time is set to an integral number of times the period of the commercial power supply of ac 100 V.

After an integrating operation is completed, the integration starting signal $\overline{\text{HOLD}}$ changes from a high level to a low level so that the switch SW3 is opened, and consequently, simultaneously when the jet current Ij is interrupted, also noises coming to the integrator OP from the input side are interrupted. Accordingly, if only the integrator OP is interrupted sufficiently, then noises which may matter are only those which are generated in the inside of the integrator OP, and consequently, the jet current Ij can be measured with a very high degree of accuracy. In this manner, a current detector having a very high performance can be constructed using simple and inexpensive devices.

The jet current Ij converted into a voltage by the integrator OP is then converted into digital data by the A/D converter ADC and outputted into a data but (not shown) to the MPU. It is to be noted that, though not shown, the integration ending signal HOLD is supplied to the MPU, and the MPU instructs the A/D converter ADC to perform an analog to digital converting operation in synchronism with the integration ending signal HOLD.

Such measurement of a current Ij described above is performed for each of the pulses $\theta_0$, $\theta_1$, $\theta_2$, . . . and $\theta_{N-1}$, which are successively displaced in phase by $2\pi n/N$ (n=0, 1, 2, . . . , N−1) from the exciting clock signal PCLK, by successively changing over the multiplexer (2) MP2 so that the vibrator 3 may be successively driven in response to the pulses $\theta_0$, $\theta_1$, $\theta_2$, . . . and $\theta_{N-1}$ to excite the nozzle 1 as seen from FIG. 16.

A value of the jet current Ij measured for each of the phases is converted from an analog value to a digital value by the A/D converter ADC and stored into a RAM (random access memory) (not shown) of the MPU.

Figure 17:
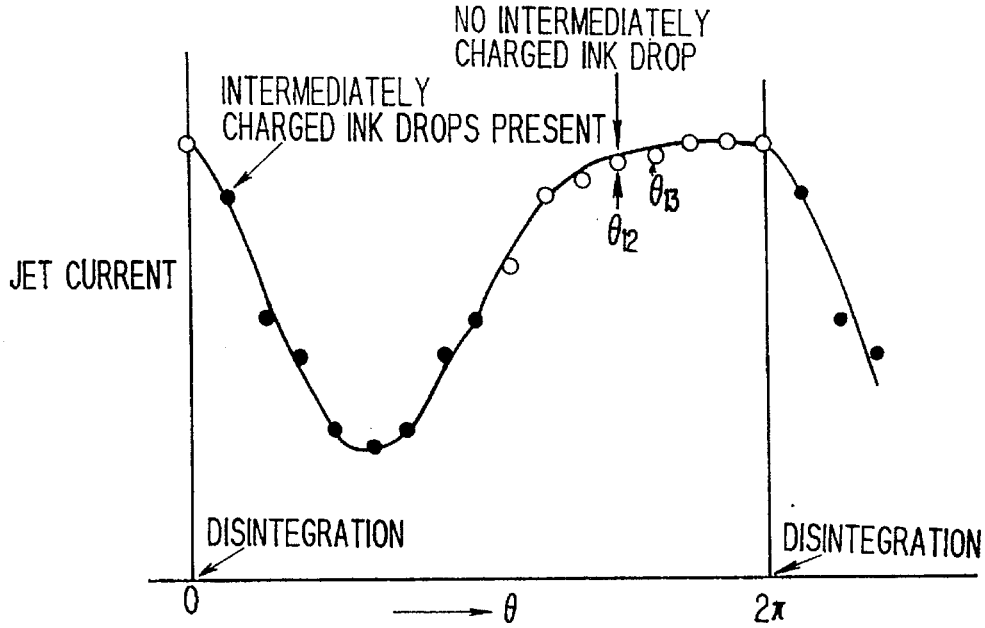
FIG. 17 is a graph showing a result of measurement of a relationship between an exciting signal and a jet current in the ink jet recording apparatus of FIG. 13.

FIG. 17 shows a result of plotting of values of the jet current Ij measured for the individual phases using test picture image data. Presence or absence of an incompletely charged ink drop is determined by observation on a stroboscope using a microscope, and a small mark ○ represents absence of an incompletely charged ink drop while another small mark • represents presence of an incompletely charged ink drop. The fact that the result of measurement indicates such a tendency as shown in FIG. 17 can be understood because such forbidden region as mentioned hereinabove appears in synchronism with an exciting signal and the jet current Ij is low when incompletely charged ink drops are present, but is high when no incompletely charged ink drop is present (refer to U.S. Pat. No. 4,839,665) and C. H. Hertz and B. A. Samuelsson, J. Imag. Tech., 15, 141, 1989).

The MPU determines, in accordance with algorithms in the form of software, an optimum phase ($\theta_{12}$ or $\theta_{13}$ in FIG. 17) with which charged ink drops and non-charged ink drops are separated completely from each other with respect to a rising or falling edge of a controlling signal against a variation in phase and no incompletely charged ink drop is produced. Then, the MPU controls the multiplexer (2) MP2 to select the phase $\theta_{12}$ or $\theta_{13}$, In the case of N=16, the jet current Ij is successively measured while the phase 8 is varied in the direction indicated by an arrow mark in FIG. 17, and preferably the optimum phase is set to a phase prior by three phase distances or so to another phase at which the jet current Ij presents a maximum value, that is, to a phase prior by amount $3 \cdot 2\pi/16=3\pi/8$ (67.5 degree) to such phase. It is to be noted that an optimum phase set once in this manner will not be changed during recording on one page of a record medium. Consequently, recording on one page of a record medium is performed in a same phase.

After completion of such phase adjustment, the MPU changes over the switch SW1 to the deflecting power source E1 side to apply a deflecting voltage to the deflecting electrode 7 in order to perform recording on a record medium. Consequently, a deflecting electric field is produced so that a charged ink drop passing between the grounding electrode 5 and the deflecting electrode 7 will be deflected to the grounding electrode 5 side and cut by the knife edge 6. Further, the MPU changes over the multiplexer (1) MP1 so as to select an output of the synchronizing circuit SC. Consequently, a pulse width modulating signal for picture element data will be inputted to the high voltage switch HVS.

On the other hand, upon recording, picture element data, which are synchronized with a picture element recording instruction signal DCLK produced from an output of a shaft encoder (not shown) directly coupled to a rotary drum (not shown), are transmitted from a line buffer (not shown; a line memory in which picture image data for one full rotation of the rotary drum are stored) to the pulse width modulator PWM, at which each picture image data are converted into a pulse width corresponding to a gradation in density thereof. An output of the pulse width modulator PWM is transmitted to the synchronizing circuit SC.

The synchronizing circuit SC synchronizes a rising or falling edge of the output of the pulse width modulator PWM with a rising or falling edge of an exciting clock signal PCLK.

An output of the synchronizing circuit SC is inputted by way of the multiplexer (1) MP1 to the high voltage switch HVS, at which it is voltage amplified to a potential necessary for charging of an ink jet to produce a controlling signal. Such controlling signal is applied to the controlling electrode 4. A jet of ink is thus induction charged in response to such controlling signal, and a drop of the thus charged ink is deflected to the grounding electrode 5 side by an action of the deflecting electric field and cut by the knife edge 6 while only a non-charged ink drop is allowed to advance straightforwardly so that is passes by the knife edge 6 and forms a dot on a record medium wrapped on the rotary drum. Consequently, recording on one page of the record medium can be performed while picture image data (output of the pulse width modulator PWM) are synchronized with the exciting signal PCLK and besides held in an optimum phase relationship with disintegration of an ink jet.

It is to be noted that, when an ink jet is interrupted once, particularly when such interruption of an ink jet continues for a long time, an optimum phase condition is varied delicately by a variation of physical property values of ink by variation of the temperature or by a variation of jetting conditions, and accordingly, it is desirable to perform a phase adjusting operation immediately before starting of each recording operation.

Further, in case the integration time is set to three times the period of the commercial power supply of ac 100 V as in the continuous jet type ink jet recording apparatus described above, a resetting section and a holding section must be added, and consequently, a total of 5 periods of the commercial power supply of ac 100 V, that is, in the case of a 50 Hz area, a total of 0.1 sec, is required for measurement of a jet current Ij of one phase. Accordingly, even if measurement is performed for a total of 16 phases (N=16), a total time required for phase adjustment is only 1.6 seconds (the processing time of the MPU can be ignored because it operates at a very high speed). Even in the case of a color ink jet printer, since measurement is performed in parallel (i.e., concurrently) for four colors (C, M, Y and BK) or three colors (C, M and Y), a time required for phase adjustment is equal to that of a continuous jet type ink jet recording apparatus for a single color.

Figure 18:
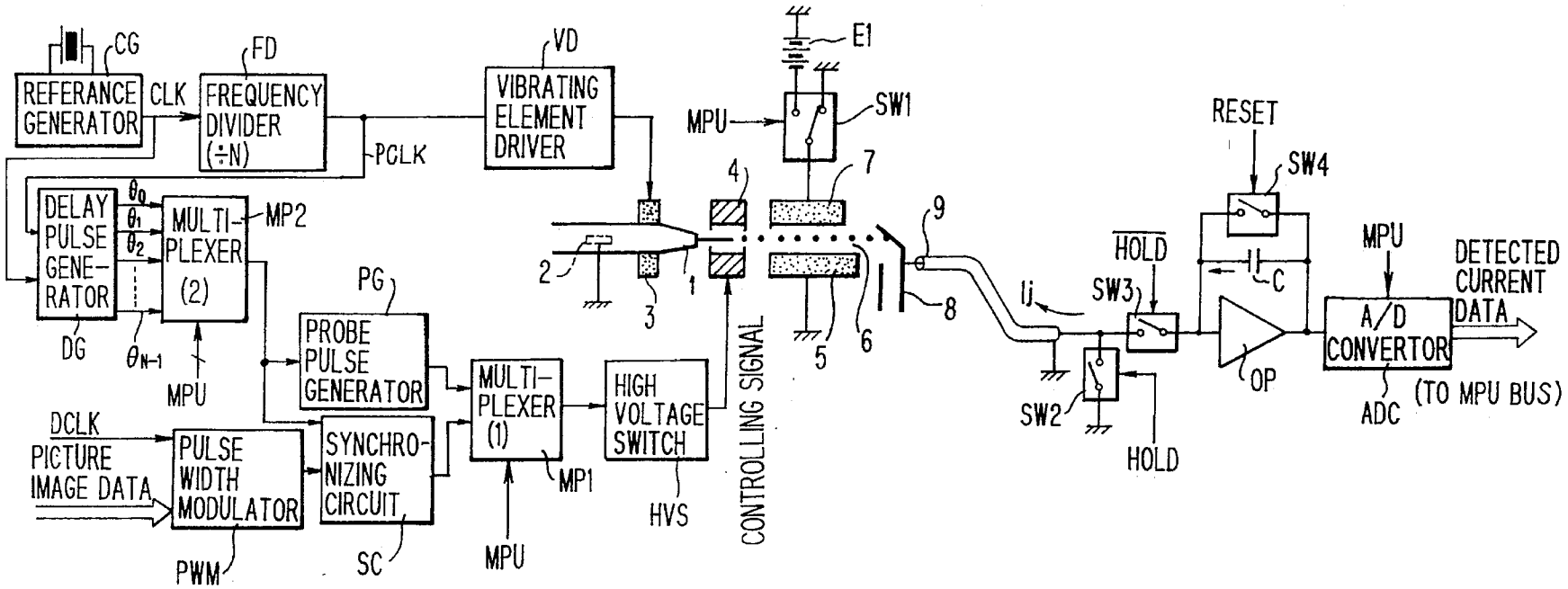
FIG. 18 is a block diagram of a continuous jet type ink jet recording apparatus showing another preferred embodiment of the present invention.
Figure 19:
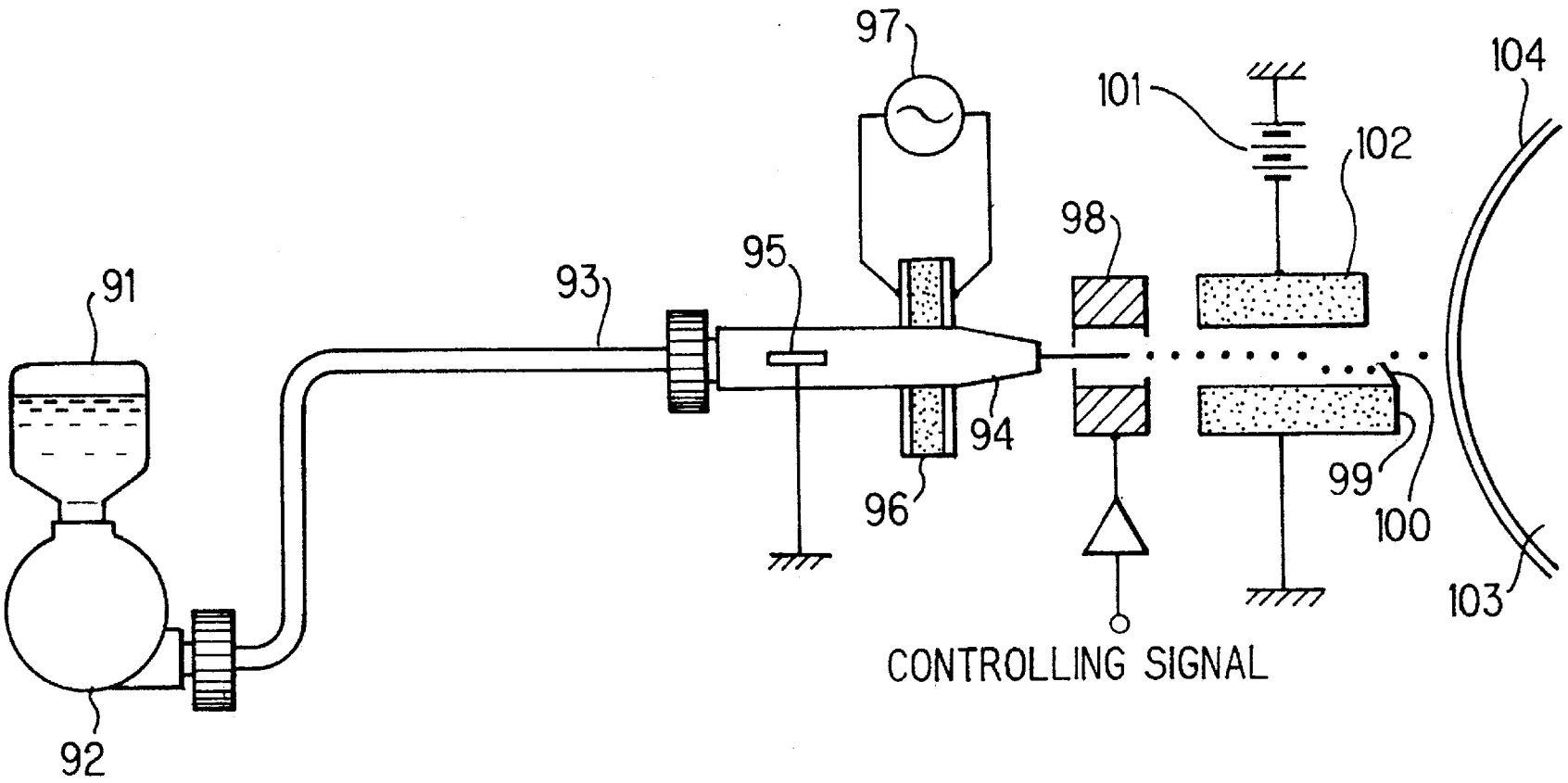
FIG. 19 PRIOR ART
FIG. 19 is a block diagram of a conventional continuous jet type ink jet recording apparatus showing a preferred embodiment of the prior art.

As shown in FIG. 18, there is shown a modification to the continuous jet type ink jet recording apparatus of FIG. 12. The modified continuous jet type ink jet recording apparatus is constructed such that, while the continuous jet type ink jet recording apparatus of FIG. 12 is constructed such that, in order to determine an optimum phase between disintegration of an ink jet and a recording pulse, an exciting clock signal PCLK is delayed to find out an optimum phase, a recording pulse is delayed to find out an optimum phase. In particular, the present continuous jet type ink jet recording apparatus is modified such that an exciting clock signal PCLK outputted from the frequency divider FD is inputted directly to the vibrating element driver VD, and an output of the multiplexer (2) MP2 is inputted to the probe pulse generator PG and the synchronizing circuit SC.

Also with the present continuous jet type ink jet recording apparatus constructed in this manner, a phase between an exciting clock signal and a recording pulse is automatically adjusted to an optimum one similarly as with the continuous jet type ink jet recording apparatus of FIG. 12 while it is only different that a phase of a controlling signal (probe pulse) is successively displaced by $2\pi/N$ to different stages when measurement of the jet current Ij is proceeded.

It is to be noted that several examinations have been conducted using a continuous jet type ink jet recording apparatus manufactured in accordance with the present invention, and it has been confirmed from the examinations that a jet current Ij can be measured at a sufficiently high S/N ratio so far as the integrating time ranges from 1 to 10 periods of the commercial power supply of ac 100 V.

Having now fully described the invention, it will be apparent to one of ordinary skill in the art that many changes and modifications can be made thereto without departing from the spirit and scope of the invention as set forth herein.

What is claimed is:

1. An optimum phase determining method for an ink jet recording apparatus of the continuous jet type, comprising the steps of:

generating a plurality of digital pulse signals in response to a digital drive signal, each digital pulse signal having a different phase relationship from one another;

forming a plurality of discrete ink drops in response to a one of the digital pulse signals and projecting the so-formed ink drops along a path;

charging the ink drops projected along the path with an electrical charge in in response to the digital drive signal and in a manner synchronous with the one of the digital pulse signals;

recovering the charged ink drops;

measuring the charge of the recovered ink drops over a selected integration period;

repeating said forming, charging, recovering, and measuring steps with each of the digital pulse signals;

determining which of the digital pulse signals provides a predetermined optimal charging of the ink drops; and forming the ink drops in response to that digital pulse signal determined to provide optimal charging of the ink drops.

2. An ink jet recording apparatus of the continuous jet type, comprising:

jet forming means including a nozzle for pressurizing ink to form a jet of such ink;

oscillating means for providing a drive signal having an oscillation frequency at or around a spontaneous droplet breakoff frequency of an ink jet;

a vibrating element mounted on said nozzle and responsive to said drive signal to cause an ink jet to separate into discrete ink drops in synchronism with the drive signal;

a charging electrode for charging ink drops in response to a charging voltage applied responsive to a digital charge signal;

means responsive to said drive signal for generating a plurality of digital charge signals, each of said digital charge signals differing in phase from one another;

an electrically isolated conductive drop catcher connected to said electrically isolated conductive drop catcher for catching drops and for providing a drop-charge signal representative of the charge level of the drops caught;

a current detector connected to said electrically isolated conductive drop catcher for detecting a jet current; and processor means connected to said jet forming means and said current detector for successively selecting each of said plural digital charge signals and applying the selected digital charge signal to said vibrating element, storing the detected charge associated with each of said plural digital charge signals, and determining that digital charge signal providing optimal charging of the ink drops.

3. An ink jet recording apparatus of the continuous jet type as claimed in claim 2, wherein said current detector includes an integrator for controlling the start and the end of an integration function integrating operation and the resetting of said integrator.

4. An ink jet recording apparatus of the continuous jet type as claimed in claim 3, wherein said switches operate in synchronism with a frequency of an ac power supply.

5. An ink jet recording apparatus of the continuous jet type, comprising:

means for forming a stream of discrete ink drops and projecting the so-formed ink drops along a path, said means for forming including means for generating a plurality of digital pulse signals in response to an excitation signal, each of said digital pulse signals having a different respective phase relationship and including means for selecting one of the plural digital pulse signals as the selected digital pulse signal;

means responsive to said excitation signal for electrically charging the ink drops projected along the path;

an electrically isolated conductive drop catcher for catching ink drops projected along the path;

means connected to said conductive drop catcher for detecting the electrical charge associated with the ink drops caught by said drop catcher and providing an electrical signal indicated of that charge; and processor means connect to said means for forming and connected to said means for detection for successively selecting each of said plural digital pulse signals as the selected pulse signal and storing the charge-indicating signal associated with each of said plural digital pulse signals, and determining that digital pulse signal providing optimal charging of the ink drops.

6. An ink jet recording apparatus of the continuous jet type as claimed in claim 5, wherein said means for detecting includes an integrator for controlling the start and the end of an integration period and the resetting of said integrator.

7. An ink jet recording apparatus of the continuous jet type as claimed in claim 6, wherein said switches operate in synchronism with a frequency of an ac power supply.

8. An ink jet recording apparatus of the continuous jet type, comprising:

ink jet forming means including a nozzle for pressurizing ink to form a jet of such ink an having a vibrating element mounted on said nozzle for breaking the ink jet into discrete ink drops in response to a digital excitation signal;

oscillating means having an oscillation frequency at or around a spontaneous droplet breakoff frequency of an ink jet and providing a recurring trigger signal therefrom;

means connected to said oscillating means and responsive to the recurring trigger signal for providing a plurality of digital excitation signals at the oscillation frequency and phase-displaced from one another;

charging means responsive to the recurring trigger signal for selectively charging an ink drop in synchronism therewith;

an electrically isolated conductive drop catcher for receiving charged ink drops;

a current detector connected to said electrically isolated conductive drop catcher for detecting a jet current that is a function of the charged ink drops received by said drop catcher; and processor means connected to said ink jet forming means and said current detector for successively applying each of the plural digital excitations signals to the ink jet forming means and storing the detected jet current associated with each digital excitation signal, and determining that digital excitation signal of the plural digital excitation signals providing optimal charging of the ink drops.

9. An ink jet recording apparatus of the continuous jet type as claimed in claim 8, wherein said current detector includes an integrator for controlling the start and the end of an integration function and the resetting of said integrator.

10. An ink jet recording apparatus of the continuous jet type as claimed in claim 9, wherein said switches operate in synchronism with a frequency of an ac power supply.

* * * * *